US008448996B2

(12) United States Patent
Lake et al.

(10) Patent No.: US 8,448,996 B2
(45) Date of Patent: May 28, 2013

(54) CASEMENT WINDOW LOCK

(75) Inventors: Rodney R. Lake, Machesney Park, IL (US); Gary M. Erickson, Lena, IL (US); Mitchell D. Gilbert, South Beloit, IL (US)

(73) Assignee: Newell Operating Company, Atlanta, GA (US)

( * ) Notice: Subject to any disclaimer, the term of this patent is extended or adjusted under 35 U.S.C. 154(b) by 1585 days.

(21) Appl. No.: 11/763,172

(22) Filed: Jun. 14, 2007

(65) Prior Publication Data

US 2008/0001413 A1 Jan. 3, 2008

Related U.S. Application Data

(60) Provisional application No. 60/814,020, filed on Jun. 14, 2006.

(51) Int. Cl.
*E05C 9/10* (2006.01)

(52) U.S. Cl.
USPC ..... 292/40; 292/111; 292/240; 292/DIG. 20; 292/DIG. 7

(58) Field of Classification Search
USPC ..... 292/40, 111 X, 157, 159, 58, 46, 292/49, 117, 124, 240 X, 241, 215, DIG. 20 X, 292/DIG. 7 X
See application file for complete search history.

(56) References Cited

U.S. PATENT DOCUMENTS

| | | | |
|---|---|---|---|
| 444,869 | A | 1/1891 | Zimmerman |
| 718,101 | A | 1/1903 | Decker |
| 1,019,623 | A | 3/1912 | Fleming et al. |
| 1,116,617 | A | 11/1914 | Page |
| 1,131,247 | A | 3/1915 | Kiekert |
| 1,163,795 | A | 12/1915 | Voight |
| 1,370,109 | A | 3/1921 | Hart |
| 2,036,151 | A | 3/1936 | Lang |

(Continued)

FOREIGN PATENT DOCUMENTS

| | | | |
|---|---|---|---|
| CA | 2276061 | A1 | 12/1999 |
| DE | 226785 | | 7/1909 |

(Continued)

OTHER PUBLICATIONS

"AJ Handbook of Architectural Ironmongery" (Section 2) Grahame Underwood and John Planck, 1977.

(Continued)

*Primary Examiner* — Carlos Lugo
*Assistant Examiner* — Mark Williams
(74) *Attorney, Agent, or Firm* — Baker & Hostetler LLP

(57) ABSTRACT

A locking mechanism for a casement window assembly includes a housing adapted to be mounted on the window assembly, an actuator operably connected to the housing and pivotable about a fulcrum, and a linkage member having a first channel and a second channel. The housing has an elongated opening having opposed ends. The actuator includes an actuator body having a first pin and a second pin located thereon. The linkage member is connected to the actuator such that the first pin is received in the first channel and the second pin is received in the second channel. Pivoting the actuator about the fulcrum causes the first pin to move within the first channel and the second pin to move within the second channel, moving the linkage member along the opening, from one end of the opening to the other end of the opening.

9 Claims, 19 Drawing Sheets

U.S. PATENT DOCUMENTS

| | | | | |
|---|---|---|---|---|
| 2,114,645 | A | | 4/1938 | van Benschoten |
| 2,136,812 | A | | 11/1938 | Carnahan |
| 2,151,219 | A | * | 3/1939 | Sern ..... 292/111 |
| 2,157,016 | A | | 5/1939 | Reynaud |
| 2,344,524 | A | | 3/1944 | Swann |
| 2,350,844 | A | | 6/1944 | van der Leun |
| 2,366,613 | A | | 1/1945 | Hagstrom |
| 2,369,584 | A | | 2/1945 | Lundholm |
| 2,486,407 | A | | 11/1949 | Hoffman |
| 2,569,046 | A | | 9/1951 | Endter |
| 2,716,262 | A | | 8/1955 | Oswald |
| 2,789,851 | A | | 4/1957 | Lickteig |
| 2,843,887 | A | | 7/1958 | Hederus |
| 2,873,134 | A | * | 2/1959 | Ahlgren ..... 292/111 |
| 2,998,323 | A | * | 8/1961 | Feldman ..... 427/70 |
| 3,032,330 | A | | 5/1962 | Stavenau |
| 3,257,755 | A | | 6/1966 | Lewis |
| 3,328,060 | A | | 6/1967 | Soderberg |
| 3,362,740 | A | * | 1/1968 | Burns ..... 292/34 |
| 3,900,965 | A | | 8/1975 | Mummert |
| 3,977,711 | A | | 8/1976 | Lajcak |
| 4,003,614 | A | | 1/1977 | Geer et al. |
| 4,095,829 | A | | 6/1978 | Van Klompenburg |
| 4,244,610 | A | | 1/1981 | Hawkins |
| 4,258,946 | A | | 3/1981 | Angioletti |
| 4,302,037 | A | | 11/1981 | Nunez |
| 4,392,329 | A | | 7/1983 | Suzuki |
| 552,950 | A | | 1/1986 | Abbott et al. |
| 4,594,865 | A | | 6/1986 | Parcell |
| 4,610,472 | A | | 9/1986 | Billingsley |
| 4,634,160 | A | | 1/1987 | Lahmann et al. |
| 4,679,352 | A | | 7/1987 | Bates |
| 4,703,960 | A | | 11/1987 | Lense |
| 4,729,584 | A | | 3/1988 | Beckerer, Jr. |
| 4,739,583 | A | | 4/1988 | Tonsmann et al. |
| 4,803,808 | A | | 2/1989 | Greisner |
| 4,807,914 | A | | 2/1989 | Fleming et al. |
| 4,840,075 | A | | 6/1989 | Tucker |
| 4,845,830 | A | | 7/1989 | Nolte et al. |
| 4,860,493 | A | | 8/1989 | Lense |
| 4,887,392 | A | | 12/1989 | Lense |
| 4,937,976 | A | | 7/1990 | Tucker et al. |
| 4,991,886 | A | | 2/1991 | Nolte et al. |
| 5,074,133 | A | | 12/1991 | Simoncelli |
| 5,083,398 | A | | 1/1992 | Kolbeck et al. |
| 5,087,087 | A | | 2/1992 | Vetter et al. |
| 5,111,615 | A | | 5/1992 | Kuhnt et al. |
| 5,118,145 | A | | 6/1992 | Tucker |
| 5,143,412 | A | | 9/1992 | Lindqvist |
| 5,152,103 | A | | 10/1992 | Tucker et al. |
| 5,201,557 | A | | 4/1993 | Schlack |
| 5,219,195 | A | | 6/1993 | Lawrence |
| 5,318,333 | A | | 6/1994 | Dreifert |
| 5,329,869 | A | | 7/1994 | Freeman et al. |
| 5,370,428 | A | | 12/1994 | Dreifert et al. |
| 5,414,899 | A | | 5/1995 | Raetz |
| 5,440,839 | A | | 8/1995 | Piltingsrud |
| 5,489,131 | A | | 2/1996 | Blom |
| 5,509,234 | A | | 4/1996 | Klimek et al. |
| RE35,463 | E | | 2/1997 | Vetter et al. |
| 5,620,214 | A | | 4/1997 | Kondratuk |
| 5,741,031 | A | | 4/1998 | Bauman et al. |
| 5,778,602 | A | | 7/1998 | Johnson et al. |
| 5,813,171 | A | | 9/1998 | Piltingsrud |
| 5,813,710 | A | | 9/1998 | Anderson |
| 5,829,802 | A | | 11/1998 | Anderson et al. |
| 5,839,767 | A | | 11/1998 | Piltingsrud |
| 5,901,499 | A | * | 5/1999 | Delaske et al. ..... 49/183 |
| 5,911,763 | A | * | 6/1999 | Quesada ..... 70/120 |
| 5,927,767 | A | | 7/1999 | Smith et al. |
| 5,927,768 | A | | 7/1999 | Dallmann et al. |
| 6,109,668 | A | | 8/2000 | Demarco |
| 6,135,511 | A | | 10/2000 | Smith et al. |
| 6,139,070 | A | | 10/2000 | Piltingsrud |
| 6,347,820 | B2 | * | 2/2002 | Subliskey ..... 292/346 |
| 6,354,639 | B1 | | 3/2002 | Minter et al. |
| 6,367,853 | B1 | | 4/2002 | Briggs |
| 6,431,620 | B2 | | 8/2002 | Tremblay et al. |
| 6,450,554 | B1 | * | 9/2002 | Rotondi et al. ..... 292/158 |
| 6,618,995 | B2 | | 9/2003 | De Marco |
| 6,622,883 | B1 | * | 9/2003 | Wu et al. ..... 220/323 |
| 6,651,389 | B2 | | 11/2003 | Minter et al. |
| 6,698,970 | B2 | | 3/2004 | Guillemet et al. |
| 6,767,038 | B1 | | 7/2004 | Huml |
| 7,004,515 | B2 | | 2/2006 | Timothy |
| 7,607,262 | B2 | * | 10/2009 | Pettit et al. ..... 49/185 |
| 7,665,775 | B1 | * | 2/2010 | Miller et al. ..... 292/240 |
| 2003/0079414 | A1 | | 5/2003 | Rangabasyam et al. |
| 2005/0198905 | A1 | | 9/2005 | Carrier |

FOREIGN PATENT DOCUMENTS

| | | | |
|---|---|---|---|
| DE | 1017940 | | 10/1957 |
| DE | 2032517 | | 1/1972 |
| DE | 2142976 | | 3/1973 |
| DE | 2341263 | | 3/1974 |
| FR | 744370 | | 4/1933 |
| FR | 1293217 | | 12/1962 |
| GB | 2175631 | A | 12/1986 |
| GB | 2283783 | A | 5/1995 |

OTHER PUBLICATIONS

"ASD Catalogue of Fittings for Windows and Doors" Archivent Sales and Developments Limited, Nov. 1971.

"Swing Fittings for Door and Window System" Worchester Parsons, undated (bearing mark "Audrey E. Knowles Chartered Patent Agent").

Titon, "Fittings for uPVC Windows and Doors", undated (notation "Interbuild 1987 collected Nov. 23, 1987").

"Jet G.U-tilt-turn gear for windows and doors in PVC" undated (bearing notation "Interbuild Nov. 29, 1985 Collected NEC").

"Favorit-KF" Bauteil Siegenia System, undated (bearing mark "Audrey E. Knowles Chartered Patent Agent").

"Catalogue Window and Door Fittings" ASD, undated (bearing mark "Dec. 6, 1979").

"Fuhr DK2001" Groupco, Technical Data undated (bearing mark "Interbuild 1987 collected Nov. 23, 1987").

"Centro 100K The Ultimate Hardware System for P.V.C. Windows and Balcony Doors" Roto, undated (bearing notation "Obtained Interbuild Nov. 1985.").

Fenestration, May/Jun. 1995, p. 43.

Truth Hardware Corp., Multi-Point Locking System (installation guide), dated 1996 (pp. 2.8-2.8g); document shows a multi-point locking system sold by assignee of U.S. Patent No. 5,118,145 and U.S. Patent No. 4,991,886 (both cited herein.).

* cited by examiner

CASEMENT WINDOW LOCK

CROSS-REFERENCE TO RELATED APPLICATIONS

The present application is a continuation-in-part of and claims the benefit of U.S. Provisional Patent Application No. 60/814,020, which application is incorporated by reference herein and made a part hereof.

FEDERALLY SPONSORED RESEARCH OR DEVELOPMENT

None.

TECHNICAL FIELD

The invention relates to casement windows, and more specifically, to a locking mechanism for locking and unlocking a casement window having increased mechanical advantage and greater range of movement in locking.

BACKGROUND OF THE INVENTION

Casement windows and locking mechanisms therefor are known in the art. However, prior casement window locks often do not generate sufficient locking force as desired by a user. Additionally, prior casement window locks often do not have a sufficient range of movement. Prior casement window locks also suffer from other disadvantages.

The present invention is provided to solve the problems discussed above and other problems, and to provide advantages and aspects not provided by prior casement window locks of this type. A full discussion of the features and advantages of the present invention is deferred to the following detailed description, which proceeds with reference to the accompanying drawings.

SUMMARY OF THE INVENTION

Aspects of the present invention provide a locking mechanism for a casement window assembly that includes a housing adapted to be mounted on the window assembly, an actuator operably connected to the housing and pivotable about a fulcrum, and a linkage member having a first channel and a second channel. The housing has an elongated opening having first and second opposed ends. The actuator includes an actuator body having a first pin and a second pin located thereon. The linkage member is connected to the actuator such that the first pin is received in the first channel and the second pin is received in the second channel. Pivoting the actuator about the fulcrum causes the first pin to move within the first channel and the second pin to move within the second channel, moving the linkage member along the opening, from a first position proximate the first end of the opening to a second position proximate the second end of the opening.

According to one aspect, the first channel has a plurality of inner surfaces and the second channel has a plurality of inner surfaces. The actuator moves the linkage member by the first and second pins exerting force on the inner surfaces of the first channel and the second channel, respectively.

According to another aspect, the linkage member travels along a path from the first position to the second position. Along a first portion of the path, the first pin exerts force on an inner surface of the first channel to move the linkage member.

Along a second portion of the path, the second pin exerts force on an inner surface of the second channel to move the linkage member.

Aspects of the present invention also provide a linkage member and an actuator suitable for use in a casement window locking mechanism. The locking mechanism described above provides examples of such a linkage member and an actuator.

Further aspects of the present invention provide a locking mechanism for a casement window assembly that includes a lock assembly adapted to be mounted on the window assembly, a lock bar operably coupled to the lock assembly, and a retainer adapted to be mounted on the casement window assembly. Manipulation of the actuator of the lock assembly causes the lock bar to move between a locked position and an unlocked position. The retainer has a passage therethrough, and the lock bar extends through the passage and is slidable within the passage between the locked position and the unlocked position. The retainer includes a flexible finger having a protrusion extending into the passage. The protrusion received in an aperture on the lock bar to hold the lock bar in place when the protrusion and the aperture are aligned. When sufficient force is applied to the actuator, the finger flexes to allow the protrusion to slip out of the aperture, allowing the lock bar to move toward the locked position or the unlocked position. Aspects of the present invention also provide a retainer for a casement window assembly. The locking mechanism described above provides an example of such a retainer.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

(FIG. 2)

DETAILED DESCRIPTION

Figure 2:
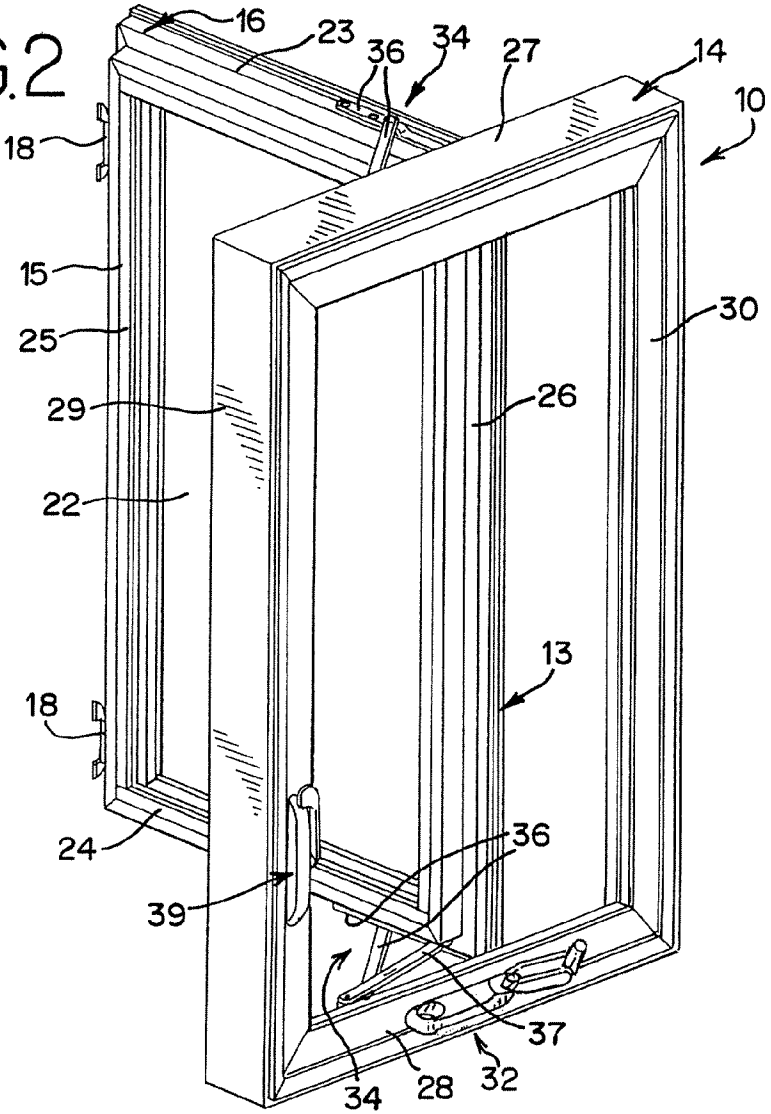
FIG. 2 is a perspective view of the casement window assembly of FIG. 1 in an open position.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1:
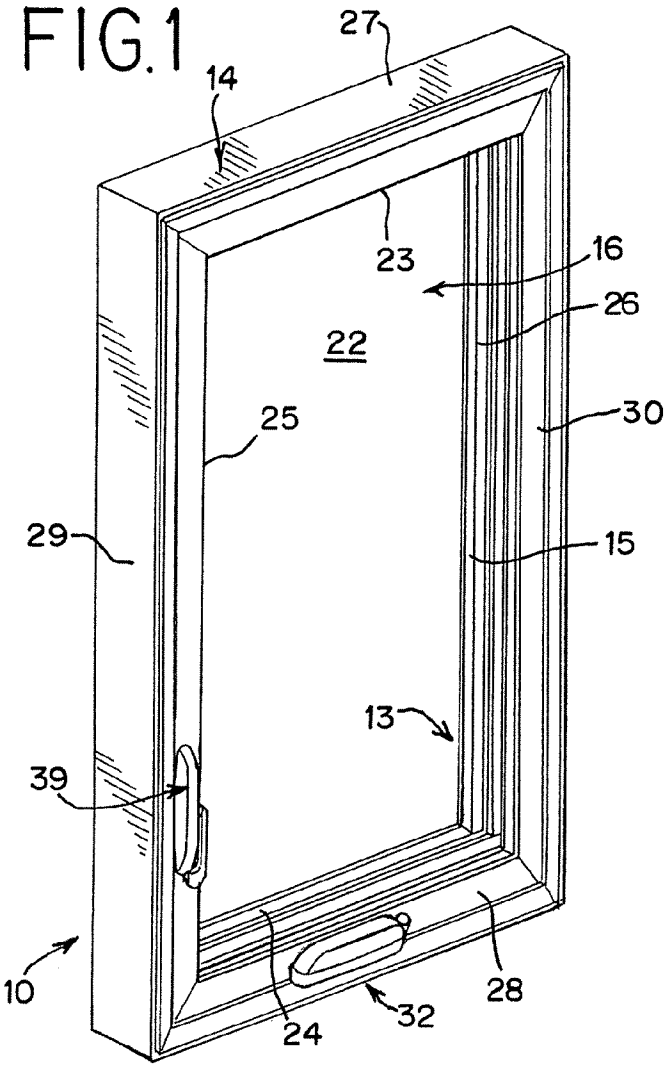
FIG. 1 is a perspective view of a casement window assembly in a closed position.
Figure 3:
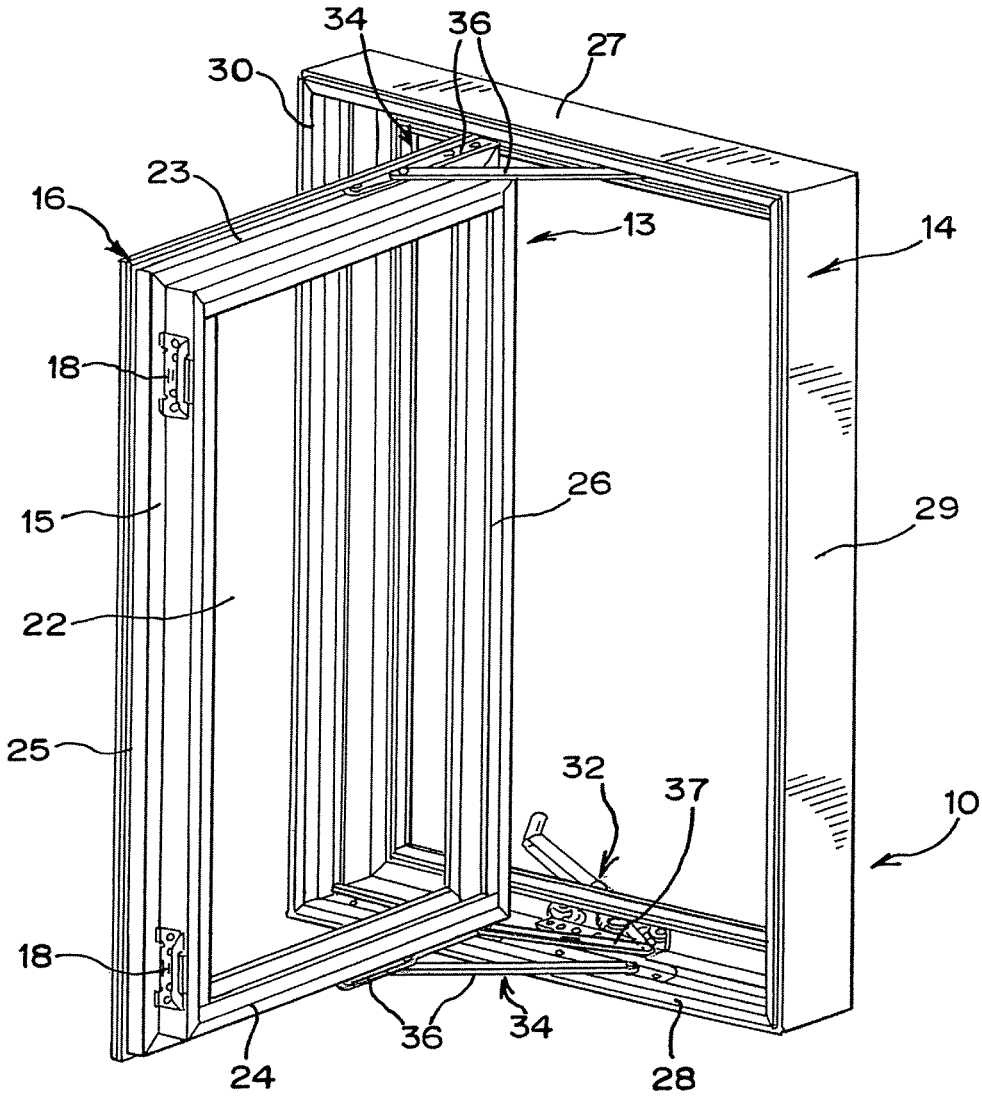
FIG. 3 is a rear perspective view of the casement window assembly of FIG. 1 in the open position.

FIG. 1 shows a casement window assembly 10, which includes a jamb frame assembly or window frame 14, and an inner window assembly or window 16. The window 16 is formed of a sash frame 15 bordering a window pane 22. The sash frame 15 is formed by two vertical rails 25,26 and two horizontal rails 23,24. The window frame 14 is formed by two vertical jambs 29,30 and two horizontal jambs 27,28. The window 16 and window frame 14 are secured by hinged connection 13, such that the window 16 is moveable between an open and closed configuration relative the frame 14 by pivotal movement of the window 16. The hinged connection 13 is formed by a hinge assembly 34 that includes one or more hinge arms 36. FIG. 1 depicts the window assembly 10 with the window 16 pivoted into the closed configuration relative the frame 14. FIGS. 2 and 3 depict the window assembly 10 with the window 16 pivoted into the open configuration relative the frame 14. The window 16 is pivoted by an operator assembly 32 that includes a actuator (not shown), a housing (not shown) mounted on the bottom jamb 28, and one or more movable arms 37 that move back and forth by cranking the actuator to move the inner window assembly 16. Two locking mechanisms 38 are positioned on one of the vertical jambs 29 and the adjacent vertical rail 25 to secure the jamb 29 to the rail 25, locking the window assembly 10 shut. It is understood that a single locking mechanism 38 can be used with the casement window assembly 10.

FIGS. 4-8 show one exemplary embodiment of a casement window locking mechanism 38 for a casement window assembly 10. The locking mechanism 38 generally includes a lock assembly 39, containing a housing 40, an actuator 60, and a linkage member 70, a lock bar 80, and a keeper 18. The actuator 60 is moveable to operate the locking mechanism 38 for locking and unlocking the window assembly 10. The locking mechanism 38 is preferably mounted to the window assembly 10 such that the housing 40 is mounted on the exterior of one of the vertical jambs 29, the actuator 60 and linkage member 70 are mounted within the housing 40, the lock bar 80 is mounted within the same jamb 29, and the keeper 18 is mounted to the vertical rail 26 adjacent the jamb 29.

Figure 7:
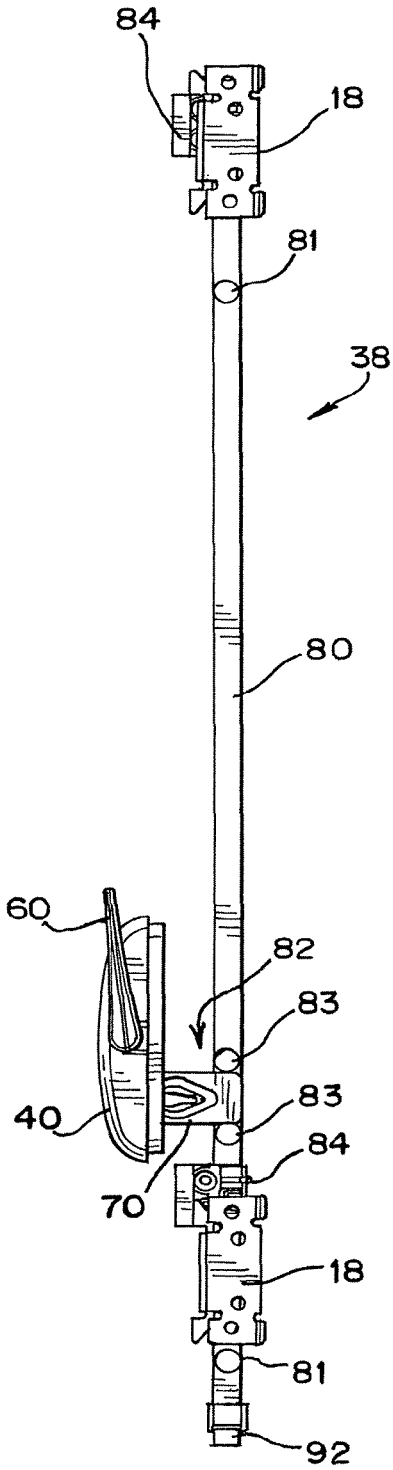
FIG. 7 is a side view of the casement window locking mechanism of FIG. 4, shown in the unlocked position.
Figure 8:
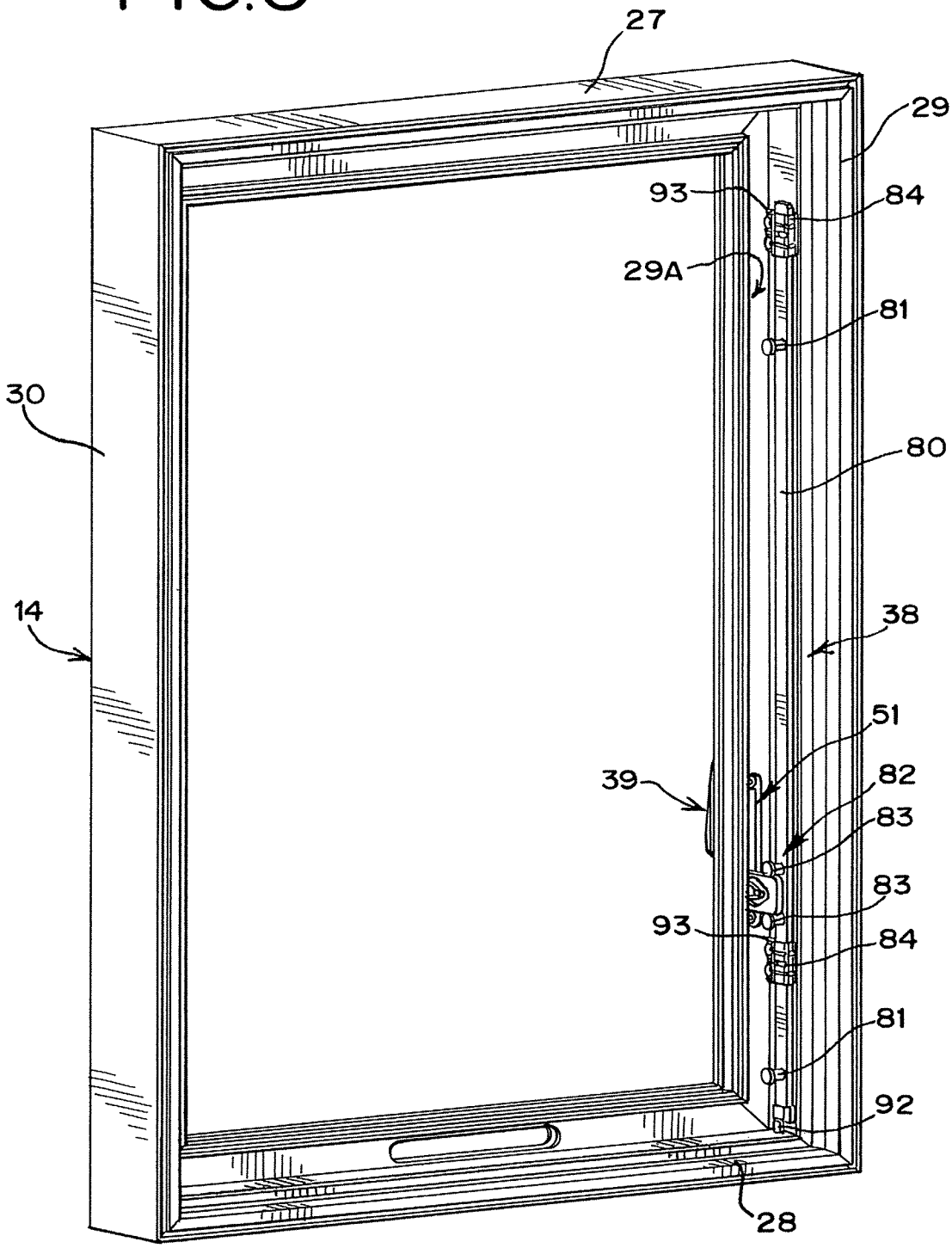
FIG. 8 is a perspective view of a portion of the casement window assembly of FIG. 1, including the casement window locking mechanism of FIG. 4, shown in the unlocked position.
Figure 11:
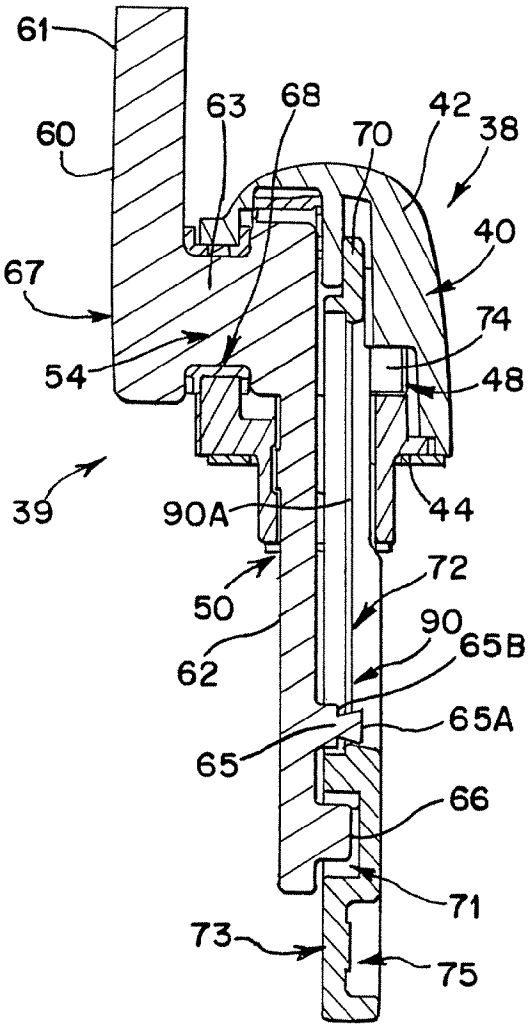
FIG. 11 is a cross-sectional view of the casement window lock of FIG. 9.
Figure 10:
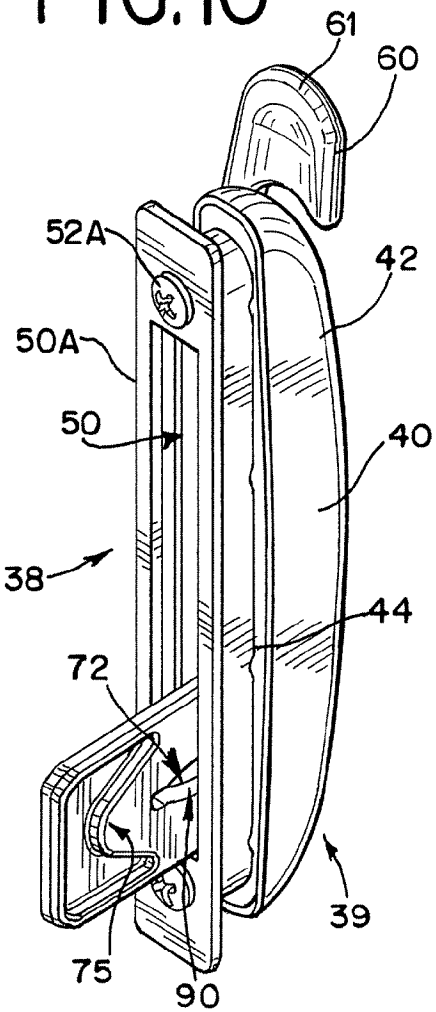
FIG. 10 is a right perspective view of the casement window lock of FIG. 9 (FIG. 13)
Figure 9:
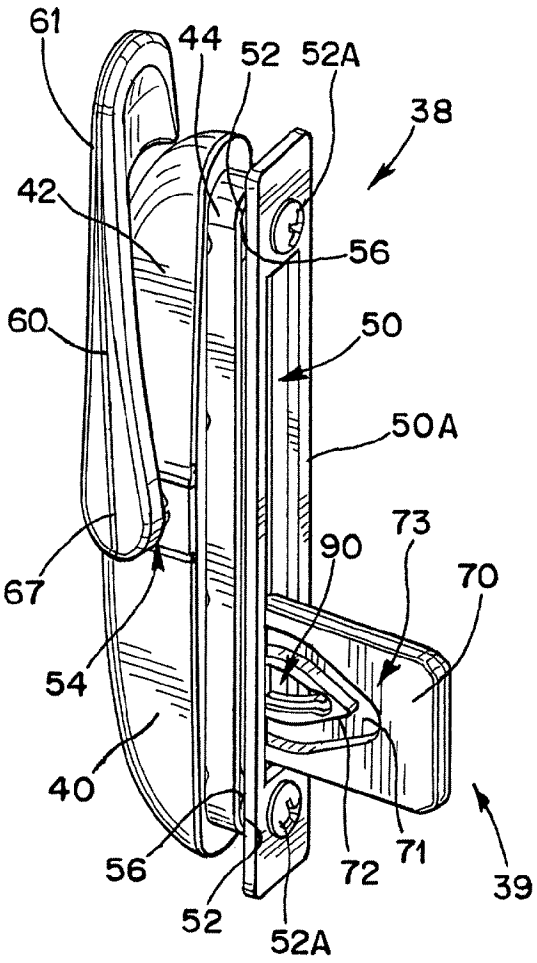
FIG. 9 is a left perspective view of a casement window lock of the locking mechanism of FIG. 4 (FIG. 12)

The lock assembly 39 of the locking mechanism 38 of FIGS. 4-8 is illustrated in FIGS. 9-11, and generally includes the housing 40, the actuator 60, and the linkage member 70, among other components. FIGS. 12-16 illustrate various components of the lock assembly 39, which are described below.

As shown in FIGS. 4-11, the housing 40 is a shell that supports and protects the other components of the lock assembly 39. The housing 40 illustrated is a two-piece metal housing 40, having a base 42 and a cover 44, and generally includes an interior cavity 46, an interior track 48, an elongated slot 50, one or more fastener holes 52, and an actuator mount 54 for supporting the actuator 60. In the embodiment shown, the cover 44 and the base 42 combine to define the interior cavity 46, and the slot 50 is formed in the cover. Additionally, the cover 44 forms part of the actuator mount 54, which, in the embodiment shown, is an aperture receiving a portion of the actuator 60 therethrough. However, in another embodiment (not shown), the cover 44 only forms the area around the slot 50, and the actuator mount 54 is completely defined by the base 42. A portion of the linkage member 70 and a portion of the actuator 60 are positioned in the interior cavity 46. The track 48, shown in FIG. 11, is an elongated groove defined within the housing 40 between the cover 44 and the base 42, and receives the projection 74 of the linkage member 70. In other embodiments, the track 48 may be a ledge, rather than a groove. The track 48 may also be formed by the insertion of a plate or block within the housing that has a ledge or a groove on which the projection 74 of the linkage member 70 can slide. When the linkage member 70 moves within the housing 40, the projection 74 rides within the track 48 and the end of the linkage member 70 moves within the slot 50. The fastener holes 52 receive fasteners 52A therethrough for attaching the housing 40 to the window frame 14. The housing 40 also has pillars 56 that extend from the base 42 through the cover 44, defining the fastener holes 52. The pillars 56 are preferably received in apertures 58 in the cover 44 to hold the cover 44 in place relative to the base 42. The housing 40 may also include a gasket or spacer 50A positioned around the slot 50.

The actuator 60 is best illustrated in FIGS. 11-13 and 16, and has a handle portion 61 and a driving portion or drive arm 62 connected by a connecting portion 63. Metal or other suitable material(s) may be used to construct the actuator 60. In the embodiment shown, the connecting portion 63 is a narrow shaft extending transversely to the handle portion 61 and the driving portion 62, giving the actuator 60 a stepped or jogged configuration. Also, as described below, the connecting portion 63 forms a fulcrum or pivot point 67 for pivoting of the actuator 60. The handle portion 61 shown has a gripping structure 64 at the tip to facilitate manipulation of the actuator 60 by a user. The driving portion 62 has two gliding pins 65,66, including a proximal gliding pin 65 that is close to the fulcrum 67 and a distal gliding pin 66 that is farther from the fulcrum 67. Because the gliding pins 65,66 are different distances from the fulcrum 67, they have different arcs of angular movement when the actuator 60 is pivoted about the fulcrum 67. Additionally, in the embodiment shown, the proximal gliding pin 65 is slightly longer than the distal gliding pin 66, the significance of which is described below. The proximal gliding pin 65 illustrated has an extended portion 65A that is narrower (having a smaller cross-sectional area) than the rest of the proximal pin 65, creating a step 65B.

The linkage member 70 of the lock assembly 39 shown in FIGS. 9-11 is illustrated in greater detail in FIGS. 12-15. The linkage member 70 illustrated is a rectangular metal plate or block body having a first channel 71 and a second channel 72 on a first face 73 of the linkage member 70 and a projection 74 on a second, opposed face 75 of the linkage member 70. The channels 71,72 are recessed from the first face 73 of the linkage member 70. In the embodiment illustrated in FIGS. 12-15, the first channel 71 is long and curved, forming a general U-shape, V-shape, or "wishbone-shape" channel 71 having two legs. The first channel 71 is defined by a plurality of inner surfaces 71A, 71B, including inward-facing surfaces 71A and outward-facing surfaces 71B. This allows room for the second channel 72 to fit entirely between the legs of the first channel 71 without intersecting the first channel 71. The second channel 72 follows a very narrow path that resembles a constricted version of the first channel 71, having a rounded tip 77, and is also defined by a plurality of inner surfaces 72A. Because the channels 71,72 do not intersect, there is no danger of sticking or malfunction due to the gliding pins 65,66 entering the wrong channel 71,72. Additionally, the second channel 72 has a hole 90 therein that extends completely through the linkage member 70. The hole 90 is generally the same shape as the second channel 72 and is recessed slightly from the edges of the channel, creating a small ledge 90A around the edges of the channel 72. In other embodiments, the linkage member 70 may have a different configuration, including differently shaped channels 71,72 and a differently shaped profile. Further, the linkage member 70 has a pair of projections 74 extending from the second face 75 of the linkage member 70, which are received in a track 48 in the housing 40 and slide along the track 48 to stabilize the linkage member 70, as discussed below and shown in FIG. 11. In exemplary embodiments, each projection 74 may be a bar, a ridge, or another protuberance that extends from the second face 75 of the linkage member 70.

Figure 12:
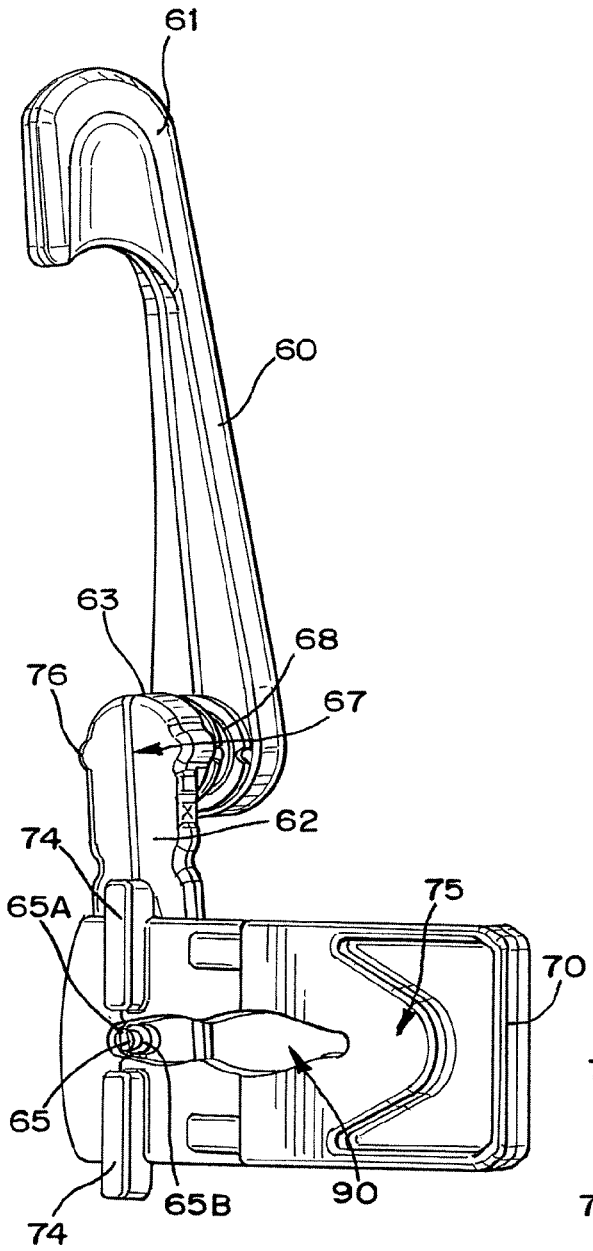
FIG. 12 is a right perspective view of an actuator and linkage member of the casement window lock of FIG. 9.
Figure 13:
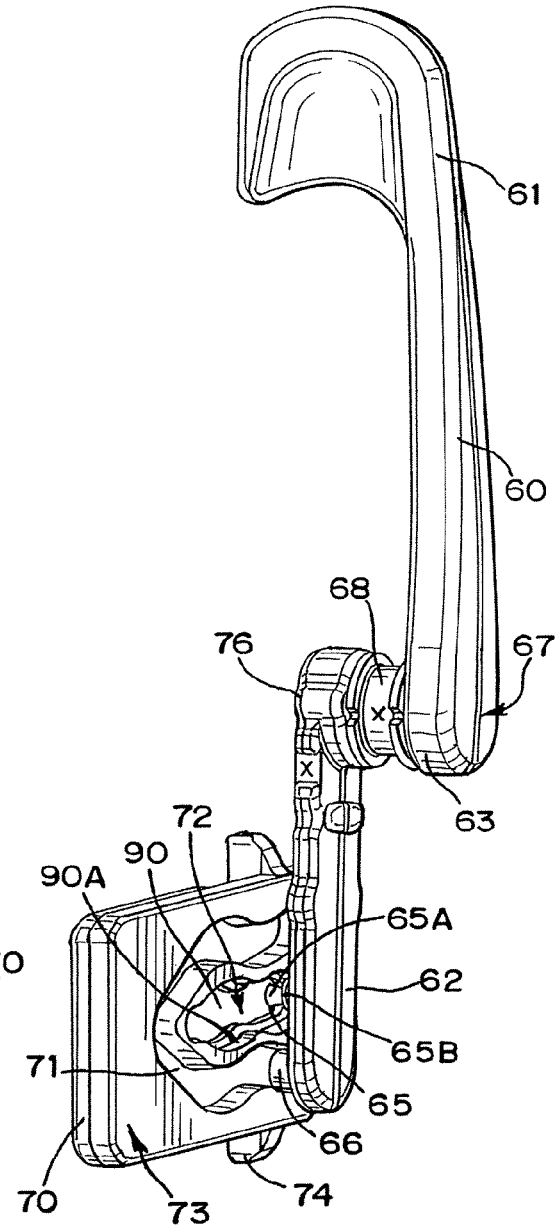
FIG. 13 is an angled view of the actuator and linkage member of FIG. 12

The actuator 60 is connected to the linkage member 70 such that the distal gliding pin 66 is received in the first channel 71 and the proximal gliding pin 65 is received in the second channel 72, as shown in FIGS. 11-13. The extended portion 65A of the proximal gliding pin 65 extends through the hole 90 and glides within the hole 90 during movement of the actuator 60, and the step 65B rides along the ledge 90A. The interaction of the extended portion 65A and the hole 90 of the second channel 72 create a more secure connection between the actuator 60 and the linkage member 70. Pivoting of the actuator 60 causes the gliding pins 65, 66 to ride within the channels 71, 72, exerting forces on the inner surfaces 71A, 71B, 72A of the channels 71, 72, thereby moving the linkage member 70, as described in more detail below.

Figure 18:
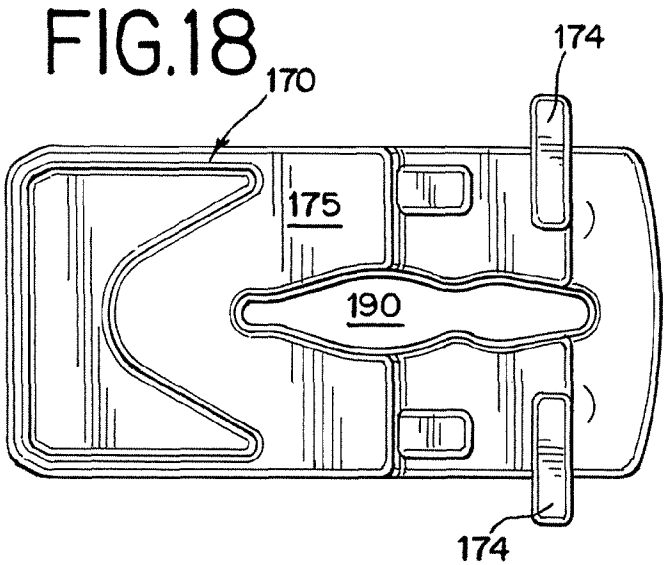
FIG. 18 is a rear view of the linkage member of FIG. 18 (FIG. 18)
Figure 20:
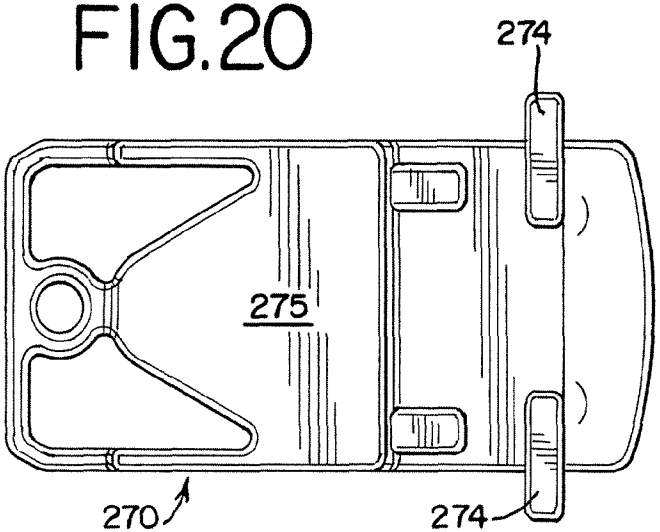
FIG. 20 is a rear view of the linkage member of FIG. 19 (FIG. 21)
Figure 17:
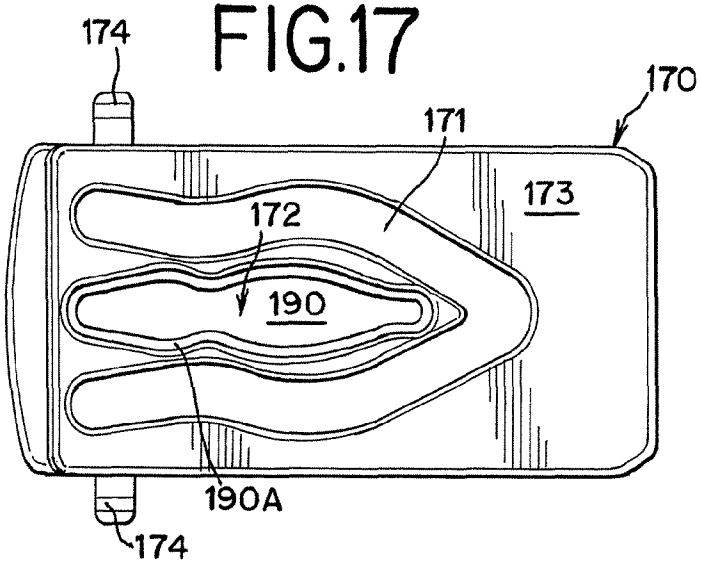
FIG. 17 is a front view of a second embodiment of a linkage member for a casement window lock (FIG. 17)
Figure 19:
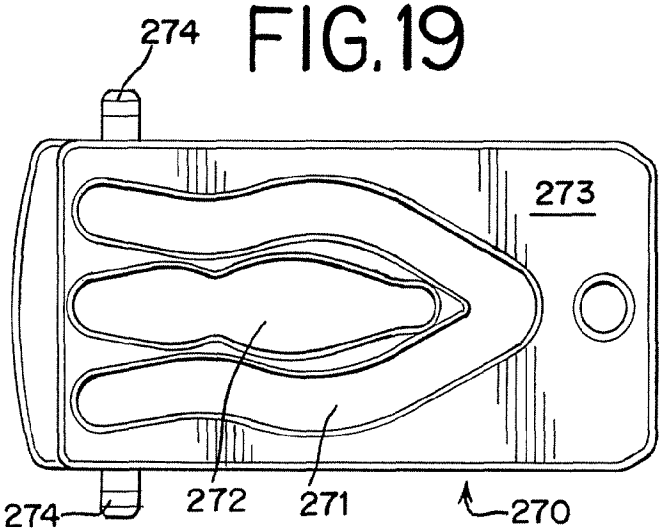
FIG. 19 is a front view of a third embodiment of a linkage member for a casement window lock (FIG. 20)
Figure 21:
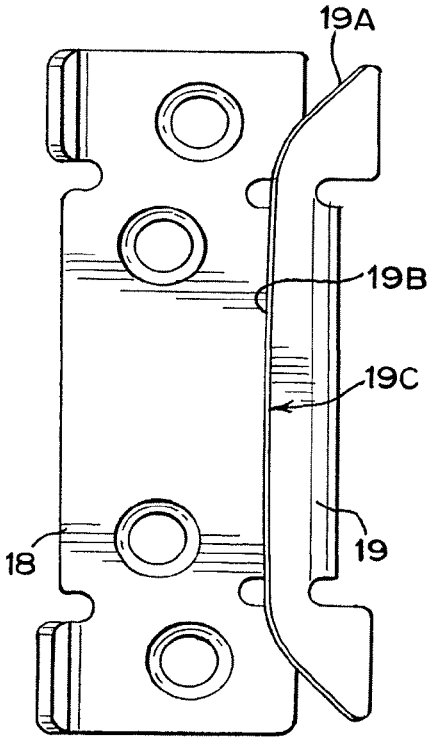
FIG. 21 is a side view of a keeper of the casement window locking mechanism of FIG. 4.

One alternate embodiment of a linkage member 170 is shown in FIGS. 17-18. This linkage member 170 is very similar to the linkage member 70 described above. One notable difference is that the projections 74 on the second face 75 of the linkage member 70 described above are longer and positioned closer together than the projections 174 on the second face 175 of the linkage member 170 of FIGS. 17-18. Other similar components of this linkage member 170 are labeled consistently with the components as described above, using the "100" series of reference numbers. This linkage member 170 can be used with a similar actuator 60 as described above. Another alternate embodiment of a linkage member 270 is shown in FIGS. 19-20. In this linkage member 270, the second channel 272 does not contain a hole extending therethrough, and has a consistent depth, unlike the second channels 72, 172 of the linkage members 70, 170 described above. Other similar components of this linkage member 270 are labeled consistently with the components as described above, using the "200" series of reference numbers. In the linkage member shown in FIGS. 19-20, the second channel 272 is shallower than the first channel 271. Thus, the linkage member 270 may be used with an actuator similar to the actuator 60 described above, however the proximal gliding pin of the actuator would be shorter than the distal pin. The contours of the channels 271, 272 are similar to the channels 71, 72 described above, and thus, the spacing of the pins from the actuator from the fulcrum may be similar to the actuator 60 described above.

The lock bar 80 is best illustrated in FIGS. 4-8 and 24-25, and is generally an elongated metal strip having one or more engagement members 81 for engaging one or more keepers 18 and a connection assembly 82 for connecting to the linkage member 70. In the embodiment illustrated, the engagement member 81 is a round post, having a narrow stem and an enlarged cap, and projects from one side of the lock bar 80. The engagement member 81 and the keeper 18 cooperatively engage each other to hold the window 16 closed, as described in more detail below. The connection assembly 82 includes two posts 83 projecting from the side of the lock bar 80, which are similar to the engagement members 81. The rectangular linkage member 70 is received between the two posts 83 so that movement of the linkage member 70 will cause the linkage member 70 to abut one of the two posts 83 and force the lock bar 80 to move in the same direction. In other embodiments, the connection assembly 82 can be configured differently and may connect to the linkage member 70 in a different manner. For example, the linkage member 70 and the connection assembly 82 may have cooperatively engaging structures or a hinge connection.

The keeper 18 is shown in FIGS. 2-7 and 21, and contains a locking bracket 19 having ramp portions 19A on each end thereof. In the embodiment shown in FIGS. 4-7, the lock mechanism 38 contains two keepers 18, and thus, the lock bar 80 contains two engagement members 81. The engagement member 81 and the keeper 18 cooperatively engage each other such that the narrow stem of the post 81 engages the locking bracket 19 of the keeper 18, and the enlarged cap limits lateral movement between the post 81 and the keeper 18. The engagement of the engagement members 81 and the locking brackets 19 of the keepers 18 is shown in FIGS. 4-7. The ramp portions 19A allow the movement of the knob 81 to pull the window 16 farther closed as the knob 81 is moved into engagement with the keeper 18, and also allow for some variation in positioning of the window 16 before locking. The bracket 19 also has a slightly curvilinear engaging surface 19B, which has a crown 19C proximate the center of the bracket 19. In other embodiments, the engagement member 81 and the keeper 18 can have many different configurations beyond those shown and described. For example, the keeper 18 may contain a locking finger that the engagement member 81 is received within.

Figure 22:
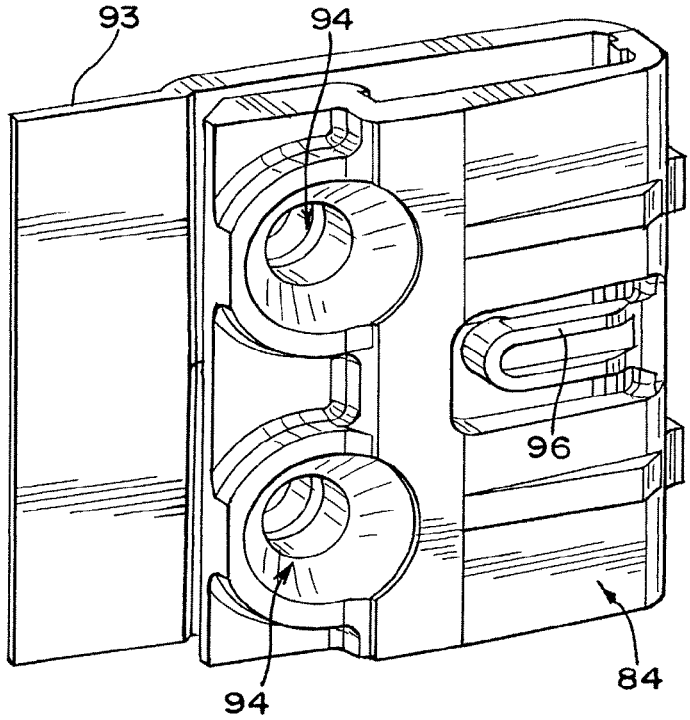
FIG. 22 is a perspective view of a retainer of the casement window locking mechanism of FIG. 4.
Figure 23:
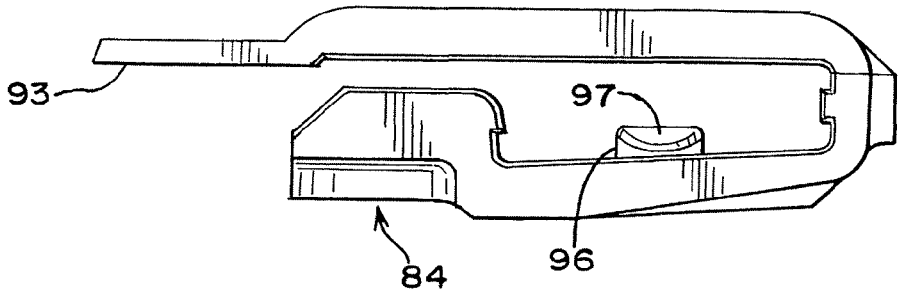
FIG. 23 is a top view of the retainer of FIG. 22.

The locking mechanism 38 includes one or more retainers 84 that are affixed to the inner surface of the window frame 14 and hold the lock bar 80, allowing the lock bar to slide back and forth within a passage in the retainer 84, as shown in FIGS. 4-8 and 24-25. A retainer 84 as shown in FIGS. 4-8 and 24-25 is illustrated in more detail in FIGS. 22-23. The retainer 84 in FIGS. 22-23 has two screw holes 94 adapted to receive screws (not shown) therethrough for connection to the window frame 14. The retainer 84 also has a tongue or flange 93 and a flexible, resilient finger 96.

The retainers 84 and the lock bar 80 contain means and structure to facilitate alignment and mounting of the locking mechanism 38 in the window frame 14. The lock bar 80 has an alignment means in the form of a tab 92 at the base of the lock bar 80. When the lock bar 80 is mounted on the vertical jamb 29 in proper alignment, the tab 92 abuts the adjacent horizontal jamb 28 to indicate that the lock bar 80 is properly spaced from the bottom of the jamb frame 14, as shown in FIG. 8. The flange 93 of the retainer 84 also forms part of an alignment means. When the locking mechanism 38 is mounted on the vertical jamb 29 in proper alignment, the flange 93 abuts an inner surface 29A of the jamb 29 to indicate that the lock bar 38 is properly spaced from the inner surface 29A, as shown in FIG. 8. In the retainer 84 shown in FIGS. 4-8 and 22-23, the flange 93 of the retainer 84 is located on a side of the retainer 84 that is opposite the screw holes 94. This permits the screw holes (and the screws) to be positioned at the outdoor-facing edge of the retainer 84. The outdoor-facing screw holes 94 provide greater security, because they are closer to the point of potential forced entry, thus resisting breakage of the retainer (which may be made of plastic) as well as reducing the potential moment arm on the screws that could be created by a tool of forced entry.

Figure 24:
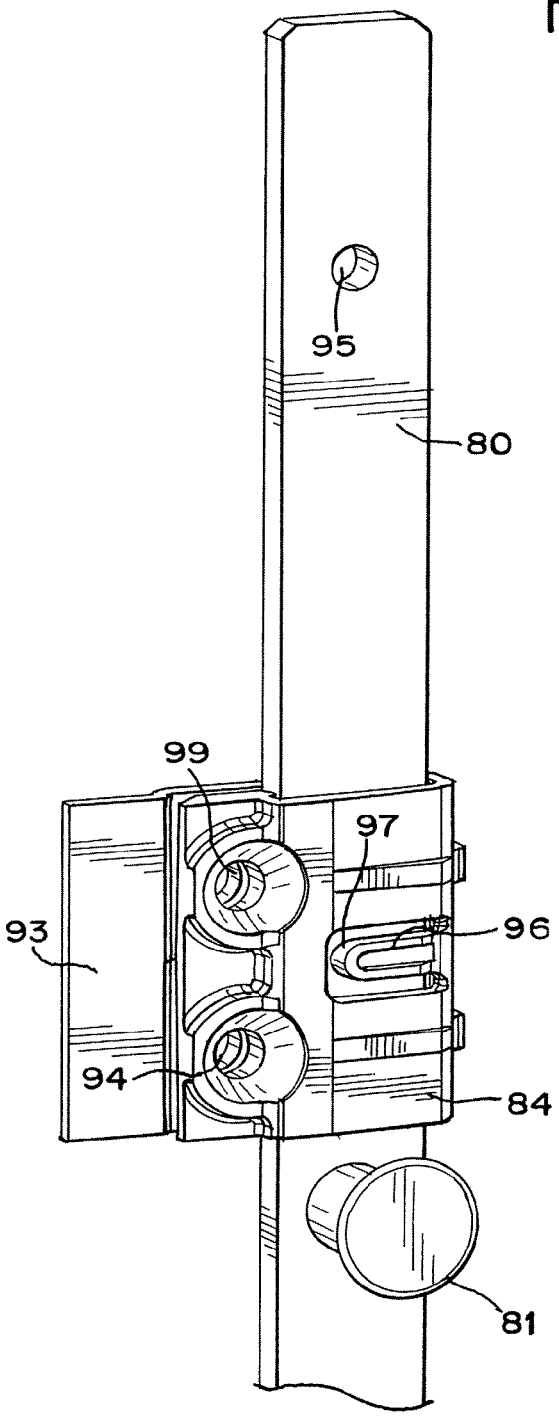
FIG. 24 is a perspective view of the retainer and the lock bar of the casement window locking mechanism of FIG. 4, shown in the locked position.
Figure 25:
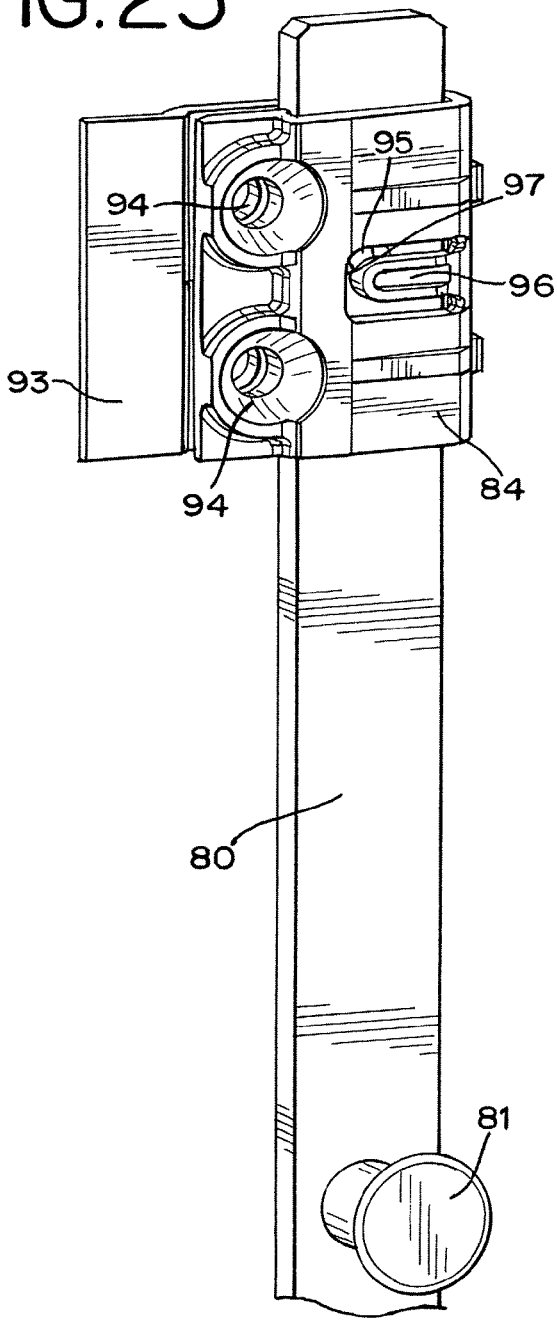
FIG. 25 is a perspective view of the retainer and the lock bar of FIG. 24, shown in the unlocked position.

The retainers 84 and the lock bar 80 also have a cooperative means for aligning the lock bar 80 with respect to the retainers 84 and for permitting shipping of the lock bar 80 and retainers 84 in an assembled condition without separating. In the embodiment illustrated in FIGS. 4-8 and 24-25, the cooperative means is formed by an aperture 95 on the lock bar and the flexible finger 96 on the retainer 84. The flexible finger 96 is cantilevered on the retainer 84 and contains a ramped protrusion 97 extending into the passage in the retainer 84. The protrusion 97 is received in the aperture 95 after assembly, when the lock bar 80 passes through the passage of the retainer 84. The engagement of the aperture 95 of the lock bar 80 and the finger 96 of the retainer 84 holds the lock bar 80 and retainer 84 in place until the connections are broken. FIG. 25 illustrates the interlocking of the finger 96 and the aperture 95 of the lock bar 80. After the locking mechanism 38 is installed in the window assembly 10, the lock bar 80 is actuated, moving with sufficient force to cause the finger 96 to flex and the protrusion 97 to slip out of the aperture 95. The ramped nature of the protrusion 97 facilitates flexing of the finger 96 by this movement. FIG. 24 illustrates the movement of the lock bar 80 so that the finger 96 is flexed outwardly and does not engage the aperture 95. Previous retainer designs utilized a rigid tab or finger having a projection that similarly engages the lock bar, and actuation of the lock bar caused the projection to be sheared from the rigid tab. The present retainer 84 is preferable to the previous design because the flexible finger 96 and ramped protrusion allows the finger 96 to flex out of the aperture 95, and no shearing of the protrusion 97 occurs. Thus, there are no loose plastic pieces potentially floating around the lock mechanism 38.

Figure 27:
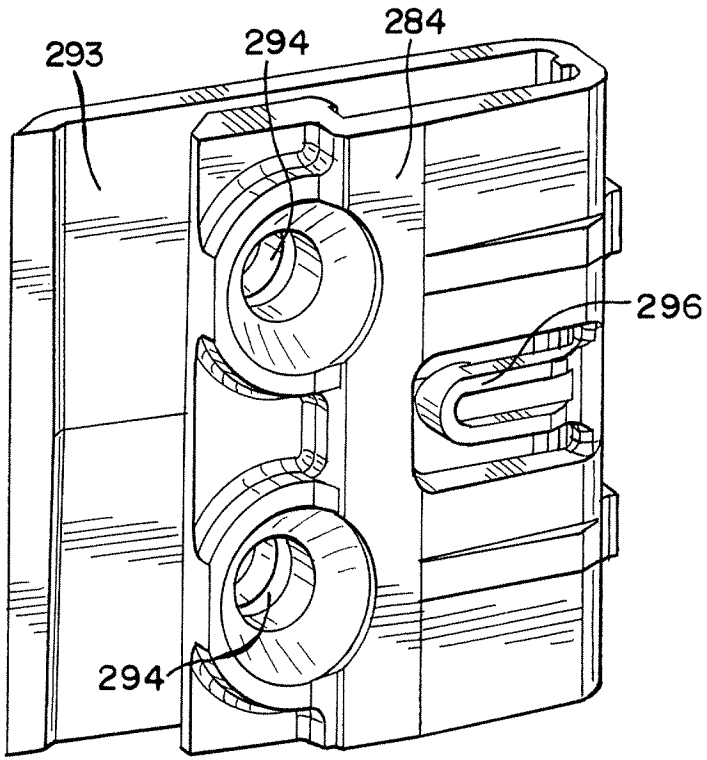
FIG. 27 is a perspective view of a third embodiment of a retainer for a casement window assembly (FIG. 27)
Figure 26:
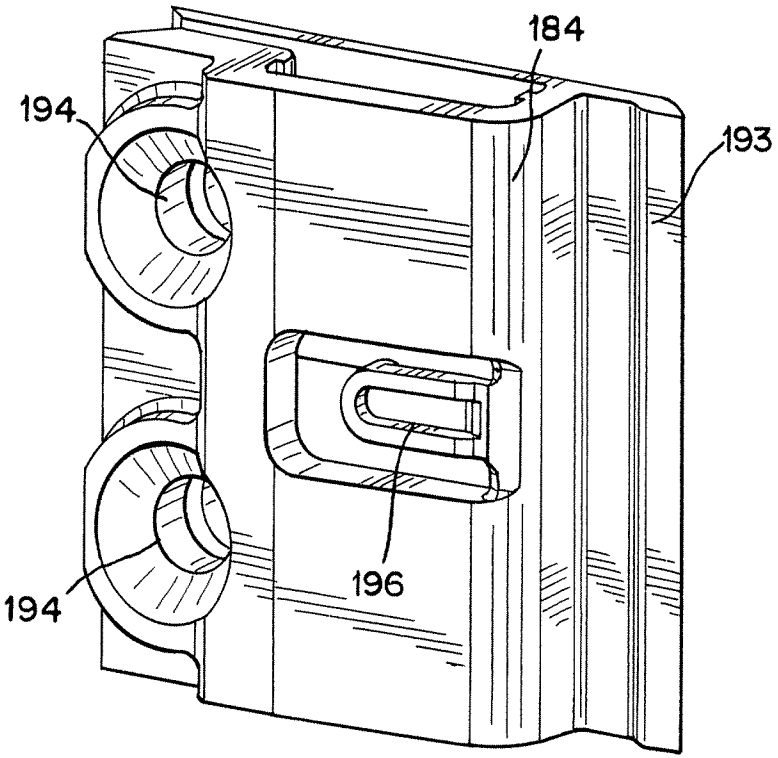
FIG. 26 is a perspective view of a second embodiment of a retainer for a casement window assembly (FIG. 25)
Figure 28:
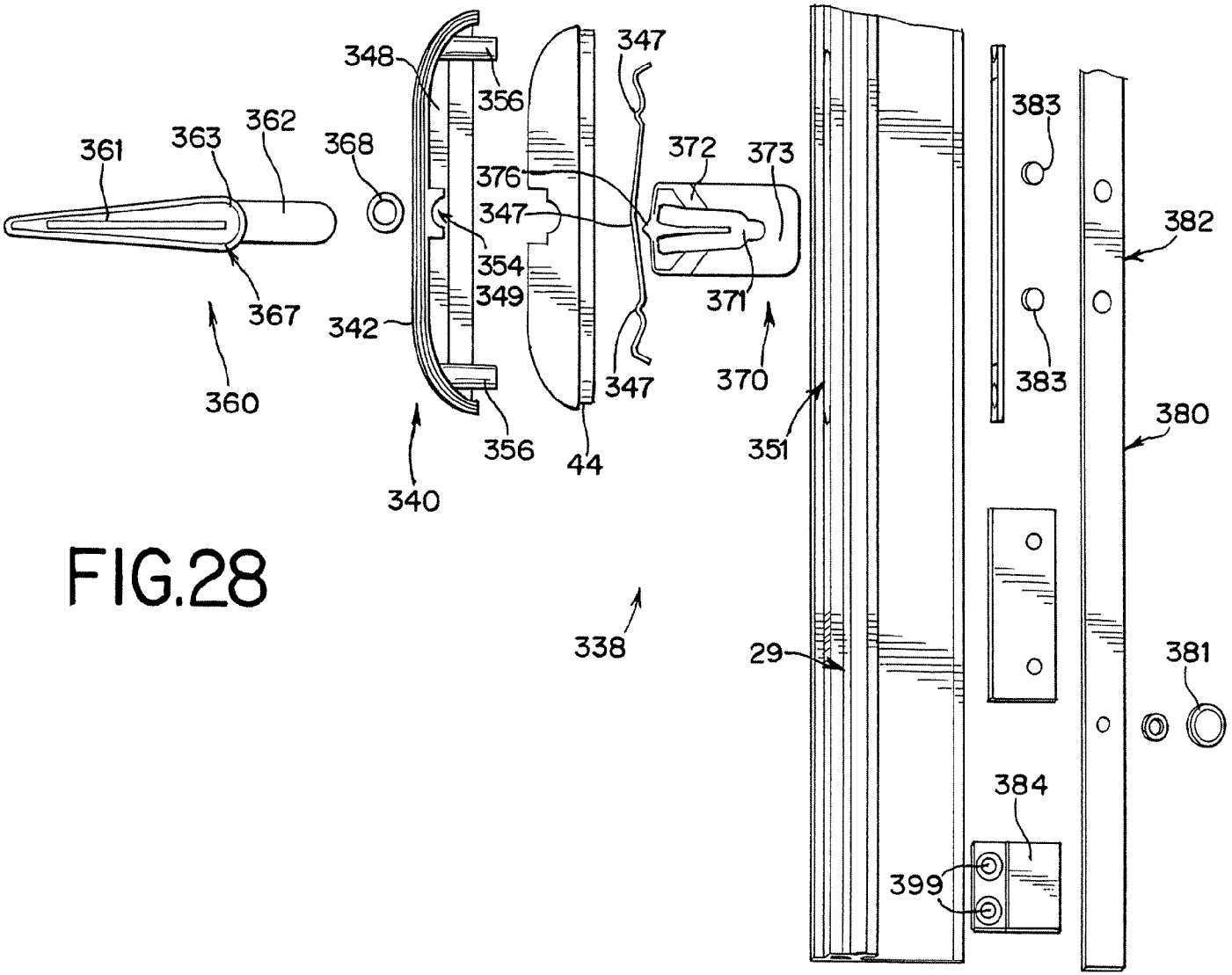
FIG. 28 is an exploded plan view of another embodiment of a casement window locking mechanism for a casement window assembly.
Figure 29:
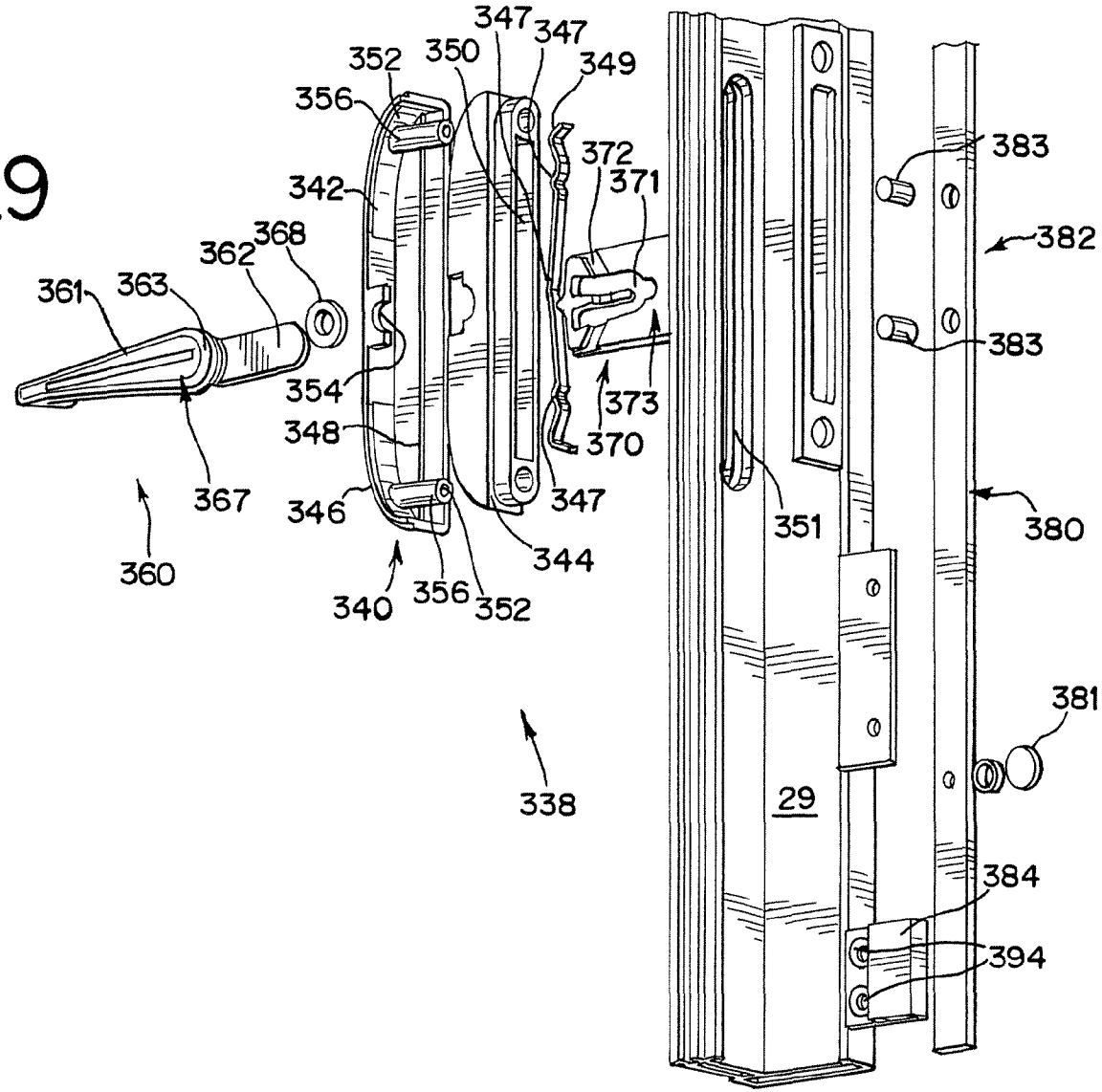
FIG. 29 is an exploded perspective view of the casement window locking mechanism of FIG. 28.
Figure 30:
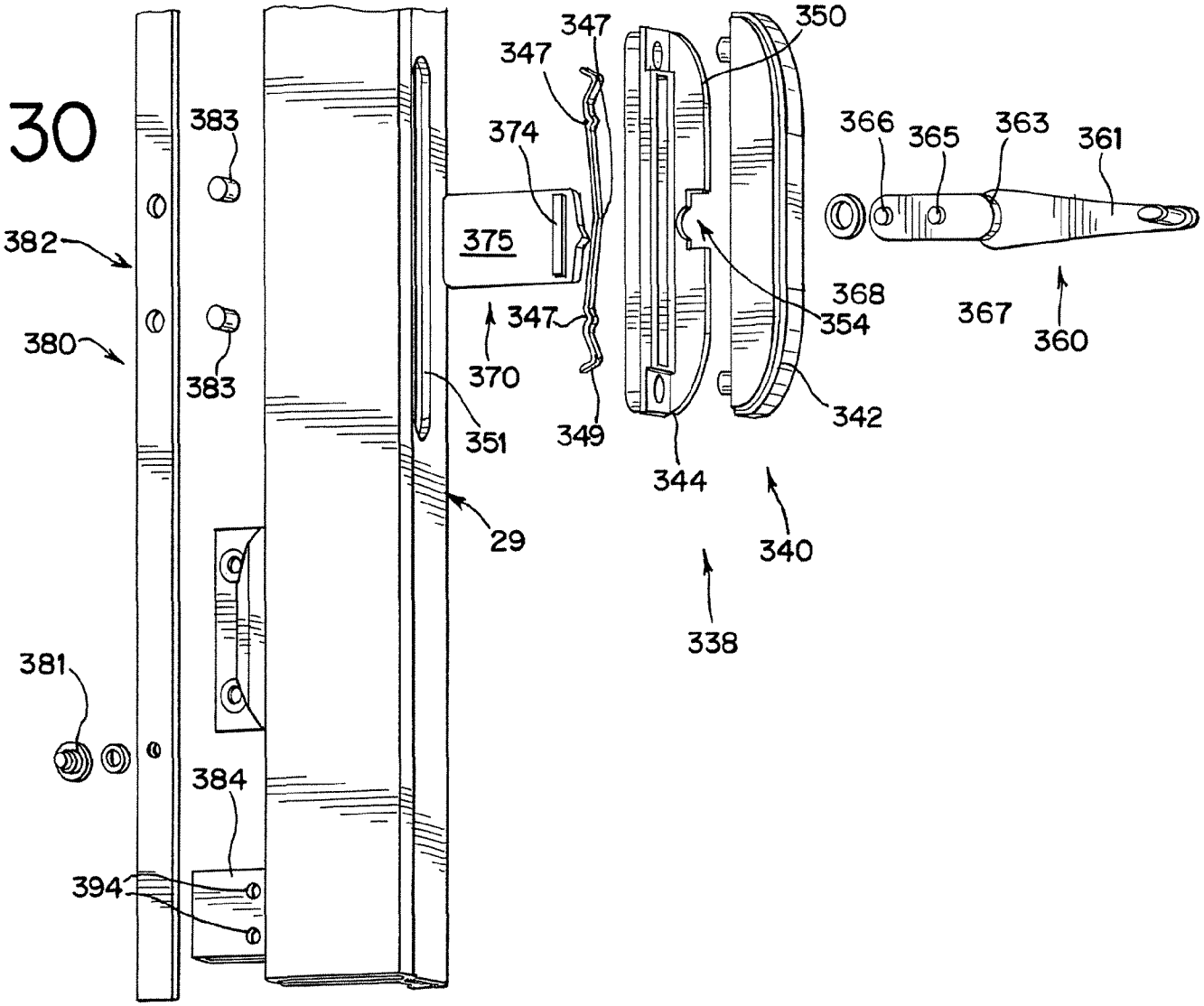
FIG. 30 is an exploded rear perspective view of the casement window locking mechanism of FIG. 28.

Another embodiment of a retainer 184 is illustrated in FIG. 26. The retainer 184 of FIG. 26 is very similar to the retainer 84 described above, and similar components are referred to with similar reference numerals, using the "100" series of reference numbers. One difference between the retainer 184 and the retainer 84 described above is the shape of the flange 193, which curves slightly upward at the end. The flange 93 of the retainer 84 described above does not curve upward appreciably. A further embodiment of a retainer 284 is illustrated in FIG. 27. The retainer 284 of FIG. 27 is very similar to the retainer 84 described above, and similar components are referred to with similar reference numerals, using the "200" series of reference numbers. The retainer 284 of FIG. 27 has the screw holes 94 on the indoor-facing side of the retainer 284, in contrast to the retainers 84, 184 described above. Another difference between the retainer 284 and the retainer 84 described above is the shape of the flange 293, which curves slightly upward at the end.

The assembled locking mechanism 38 is shown in FIGS. 4-8, and the locking mechanism 38 is shown installed in the casement window assembly 10 in FIGS. 1-3 and 8. As illustrated, the actuator 60 and the linkage member 70 are connected to the housing 40, and are partially positioned within the housing 40. The connecting portion 63 of the actuator 60 is received through the aperture 54 in the housing 40. In this arrangement, the handle portion 61 of the actuator 60 is positioned outside the housing 40 and the driving portion 62 of the actuator moves within the housing 40. Additionally, the aperture 54 combines with the connecting portion 63 to provide the fulcrum or pivot point 67, forming a pivot axis about which the entire actuator 60 pivots. A bushing or bearing 68 may be positioned between the connecting portion 63 and the actuator mount 54, allowing for smoother pivoting of the actuator 60. The linkage member 70 is also positioned partially within the housing 40 and slides back and forth within the housing 40 with the movement of the actuator 60. The slot 50 is elongated to allow the linkage member 70 a wide range of motion as it moves from one end of the slot 50 to the other. The jamb 29 also has a slot 51 (see FIG. 8) corresponding to the slot 50 of the housing 40, through which the linkage member 70 extends to connect to the lock bar 80. The track 48 preferably receives the projection 74 of the linkage member 70. As the linkage member 70 moves within the housing 40, the projection 74 slides within the elongated track 48, from one end of the track 48 to the other, and the track 48 stabilizes the linkage member 70, ensuring that the linkage member 70 moves linearly rather than rotating.

Figure 14A:
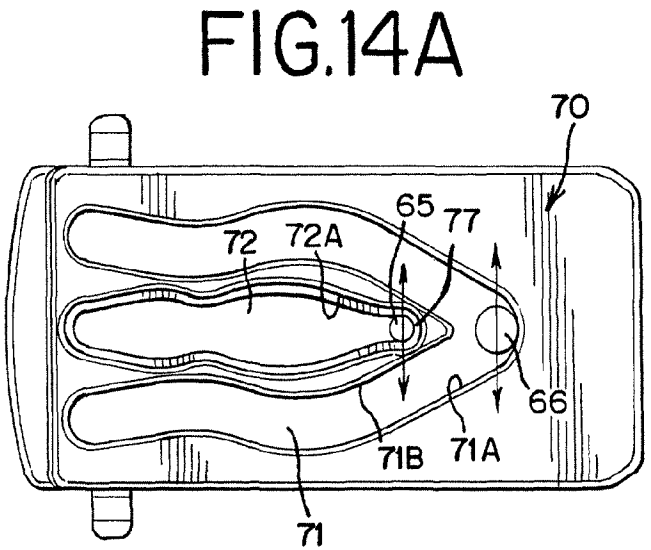
FIG. 14A is a front view of the linkage member of FIG. 12, shown with two gliding pins driving movement of the linkage member in the direction indicated by the arrows.
Figure 14C:
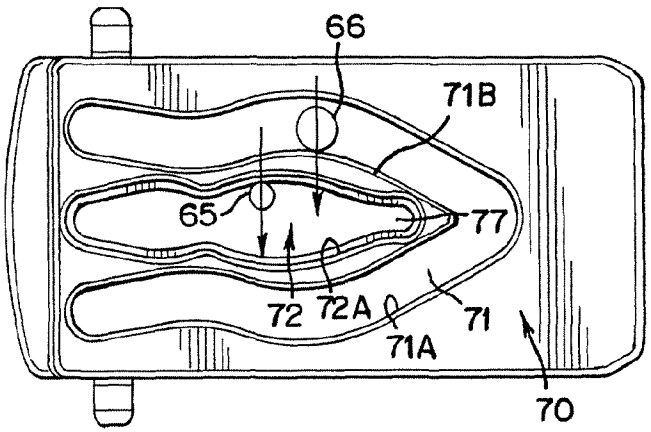
FIG. 14C is a front view of the linkage member of FIG. 12, shown with two gliding pins driving movement of the linkage member in the direction indicated by the arrows.
Figure 14:
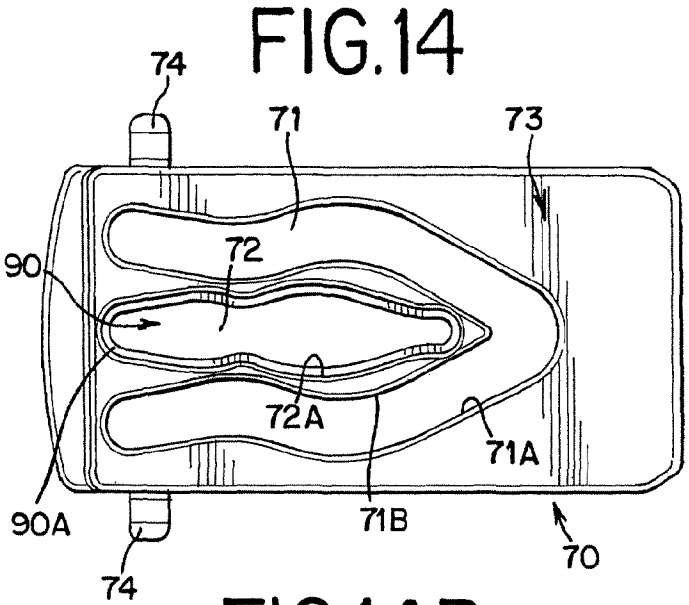
FIG. 14 is a front view of the linkage member of FIG. 12.
Figure 14B:
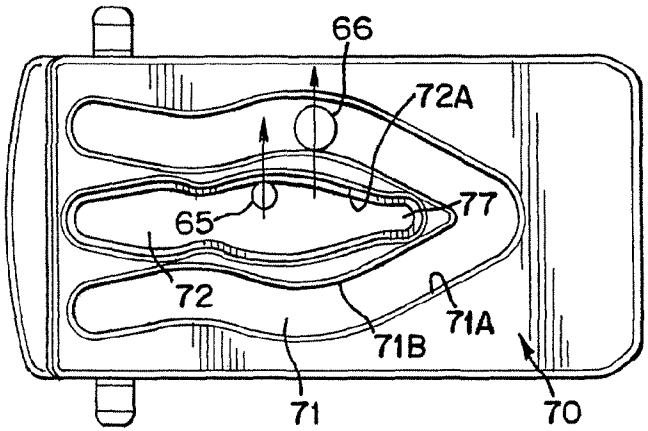
FIG. 14B is a front view of the linkage member of FIG. 12, shown with two gliding pins driving movement of the linkage member in the direction indicated by the arrows.
Figure 15:
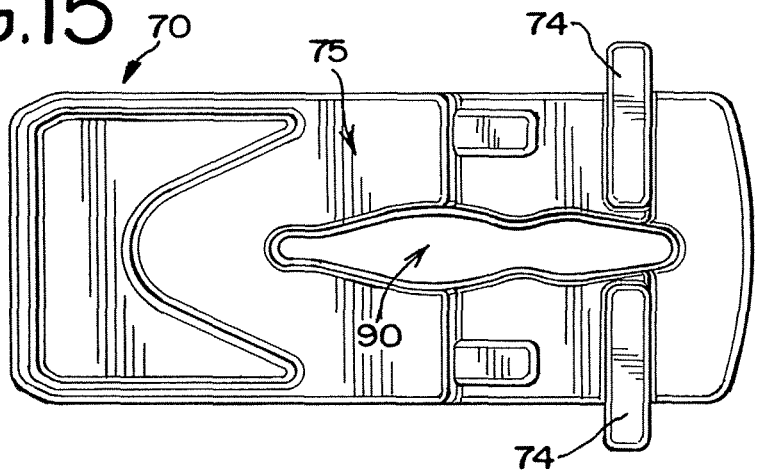
FIG. 15 is a rear view of the linkage member of FIG. 12.

The actuator 60 and linkage member 70 are movable in a range of movement between a first position and a second position, each proximate one of the ends of the slot 50. The driving portion 62 of the actuator 60 and the linkage member 70 are connected such that pivoting of the actuator 60 is translated into linear motion by the linkage member 70 to achieve a mechanical advantage. The actuator 60 is connected to the linkage member 70 such that the distal gliding pin 66 is received in the first channel 71 and the proximal gliding pin 65 is received in the second channel 72. As the actuator 60 is pivoted, the proximal gliding pin 65 glides through the second channel 72 and the distal gliding pin 66 glides through the first channel 71. The gliding pins 65, 66 exert forces upon the inner surfaces 71A, 71B, 72A of the channels 71, 72 during pivoting of the actuator 60 to move the linkage member 70 within the housing 40. Generally, the linkage member travels along a path from the first position to the second position, and at certain points or intervals along the path, the motion may be driven differently. For example, through some portions of the path, both the proximal and distal gliding pins 65, 66 may be exerting forces on the inner surfaces 71A, 71B, 72A of the channels 71, 72 to drive the movement of the linkage member 70, such as illustrated in FIG. 14A. Through other portions of the path, only the proximal gliding pin 65 may be driving the movement of the linkage member 70, such as illustrated in FIG. 14B, and through other portions, only the distal gliding pin 66 may be driving the movement of the linkage member 70, such as illustrated in FIG. 14C. The arrows in FIGS. 14A-14C illustrate the direction of pivoting of the actuator 60 and the direction of movement of the linkage member 70. The direction of movement of the actuator 60 can be reversed to move the linkage member 70 back and forth along the path between the first and second positions. However, as shown by FIGS. 14B and 14C, a different gliding pin 65, 66 may be driving the movement of the linkage member 70 when the actuator 60 is in the same position relative to the linkage member 70, depending on the direction of movement of the actuator 60. It is understood that even slight variations of the dimensions and shapes of the channels 71, 72 may change the locations and ranges of movement where each pin 65, 66 drives the movement of the linkage member 70.

Figure 16:
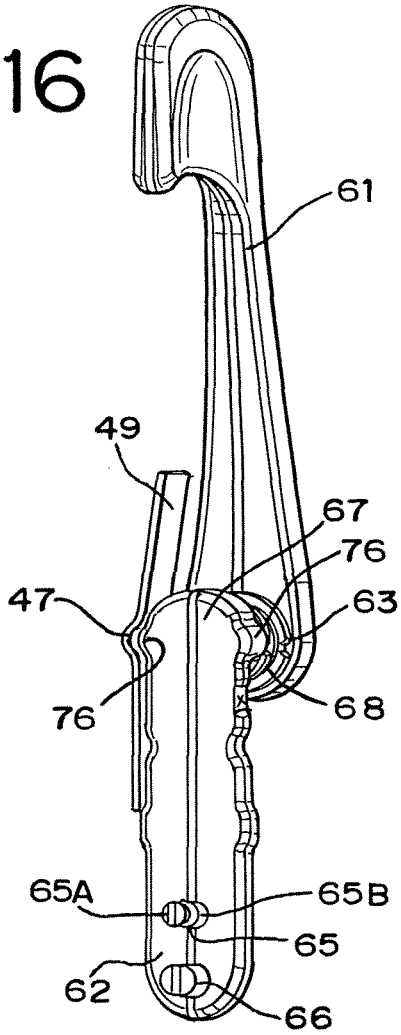
FIG. 16 is a perspective view of the actuator and a spring of the casement window lock of FIG. 9.

As the linkage member 70 moves within the housing 40, the projection 74 rides within the track 48 of the housing 40, stabilizing and guiding the motion of the linkage member 70. This engagement helps ensure linear motion of the linkage member 70. Also, as shown in FIG. 16, the locking mechanism 38 has a spring 49 positioned within the housing that creates a "click" to indicate that the actuator 60 has moved to the locked or unlocked position. The spring 49 interacts with nubs 76 on the actuator 60 at the fulcrum 67 to produce this effect. The spring 49 has an indent 47 and the actuator 60 has two circumferentially-opposed nubs 76, and one of the nubs 76 is received in the indent 47 in the spring 49 at each extreme end of movement of the actuator 60. As the nub 76 slips into the indent 47, the spring 49 produces the "click" mentioned above.

The movement of the actuator 60 and the linkage member 70 described above effects movement of the lock bar 80 to lock and unlock the window assembly 10. As described above, the engagement member 81 engages the keeper 18, securing the window 16 and preventing the window 16 from opening. Additionally, the linkage member 70 is operably connected to the connection assembly 82 of the lock bar 80, such that movement of the actuator 60 moves the linkage member 70, which in turn moves the lock bar 80 to engage or disengage with the keeper 18. As described above, the linkage member 70 is received between the two posts 83 of the lock bar 80, connecting the linkage member 70 to the lock bar 80. Thus, the locking mechanism 38 is moveable between a locked position, where the engagement member 81 of the lock bar 80 engages the keeper 18 and the window assembly 10 is locked closed, and an unlocked position, where the engagement member 81 of the lock bar 80 does not engage the keeper 18 and the window assembly 10 may be freely opened and closed.

Figure 4:
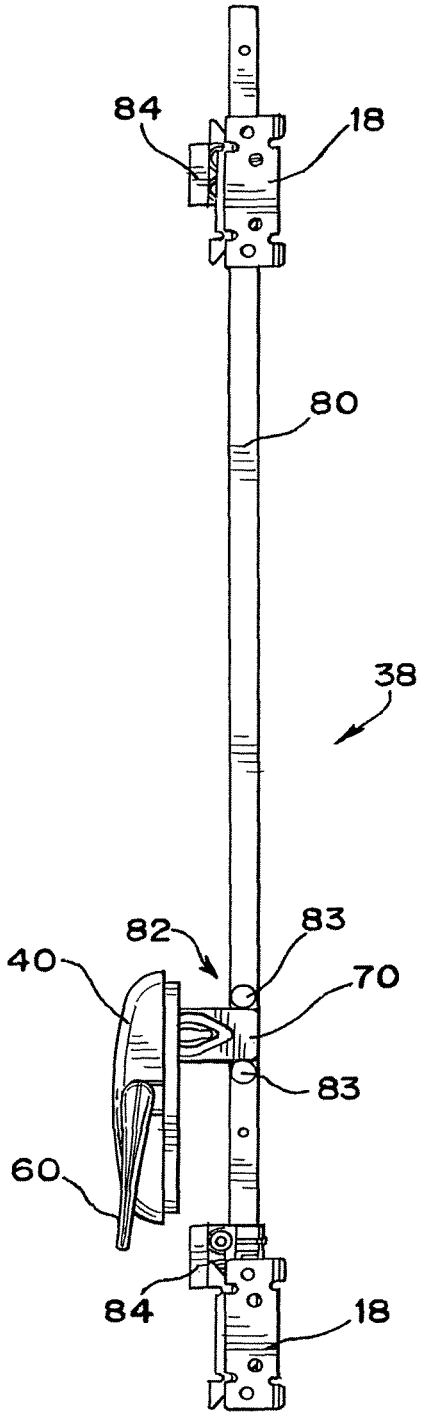
FIG. 4 is a side view of one embodiment of a casement window locking mechanism of the casement window assembly of FIG. 1, shown in a locked position.
Figure 5:
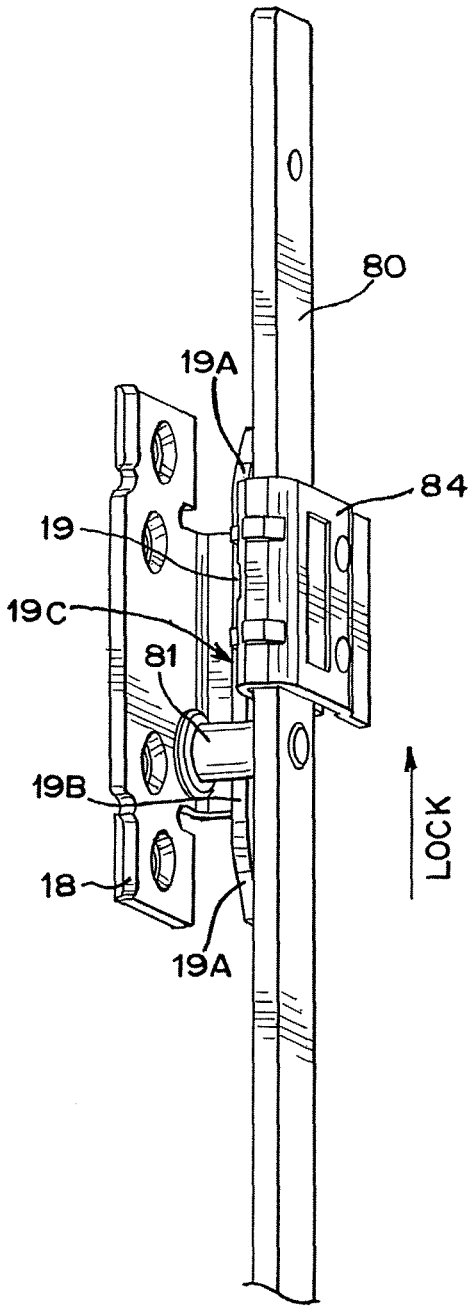
FIG. 5 is a perspective view of a top keeper and a lock bar of the casement window locking mechanism shown in FIG. 4.
Figure 6:
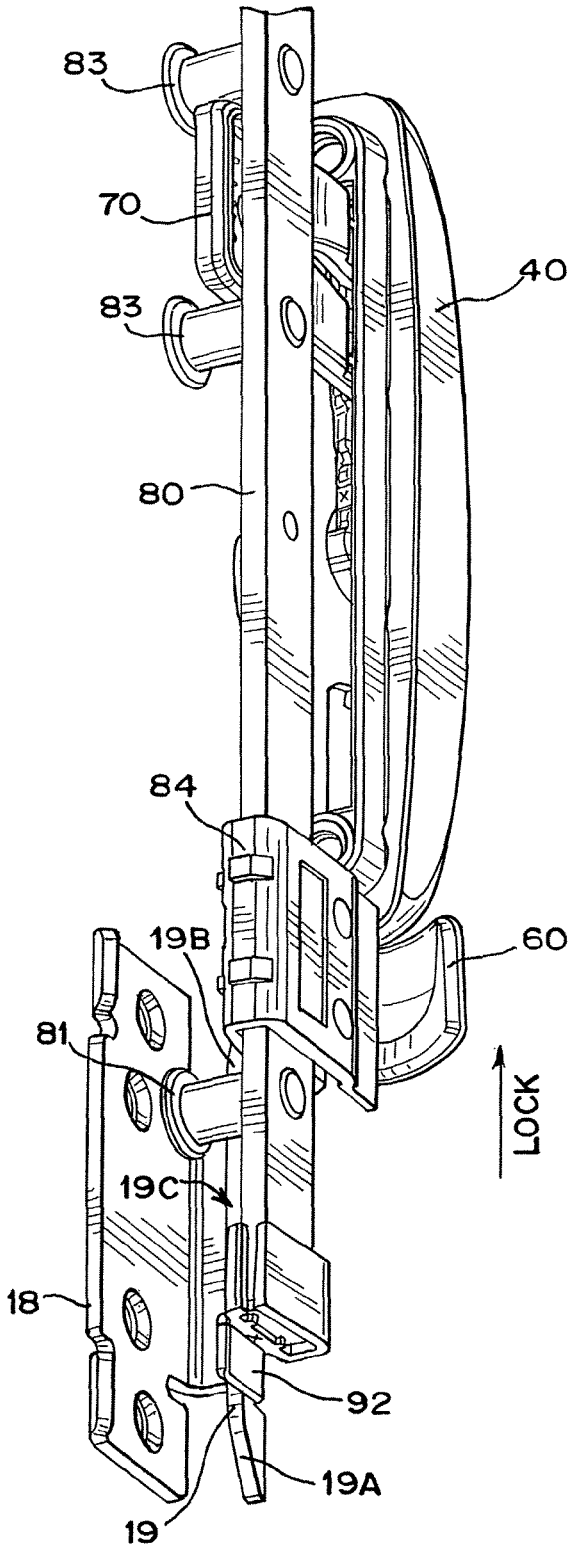
FIG. 6 is a perspective view of a bottom keeper and a lock bar of the casement window locking mechanism shown in FIG. 4.

The locking and unlocking of the locking mechanism 38 is illustrated in FIGS. 4-7. FIG. 4 shows the locking mechanism 38 in the locked position. As shown, the linkage member 70 has moved the lock bar 80 upward so that the engagement members 81 are engaged with the keepers 18, securing the jamb 29 to the rail 26 and locking the window assembly 10 shut. FIGS. 5 and 6 depict the engagement between the engagement members 81 and the lower and upper keepers 18, respectively. The arrows labeled "Lock" in FIGS. 5 and 6 depict the direction of movement of the lock bar 80 in moving to the locked position. FIG. 7 shows the locking mechanism 38 in the unlocked position. As shown, the linkage member 70 has moved the lock bar 80 downward so that the engagement members 81 are not engaged with the keepers 18, and the window (not shown) is free to open. In the embodiment shown in FIGS. 4-8, the locking mechanism 38 uses a sequential locking operation. In other words, the lower engagement member 81 engages the lower keeper 18 before the upper engagement member 81 engages the upper keeper 18. Thus, when the locking mechanism 38 is in the locked position, the lower engagement member has moved far along the lower locking bracket 19, past the crown 19C of the bracket 19, as shown in FIG. 6. In contrast, the upper engagement member has not moved as far along the upper locking bracket 19, and has not moved past the crown 19C of the bracket 19, as shown in FIG. 5. In a larger window assembly 10, the lock bar 80 may lock 3 or more keepers 18 sequentially. The greatest locking force involved in locking a keeper 18 is necessary prior to the engagement member 81 reaching the crown 19C of the bracket 19. Once the engagement member 81 has passed the crown 19C, the locking force is reduced because of the declining slope of the engaging surface 19B. Since the locking mechanism 38 locks each keeper 18 sequentially, the lock assembly 39 only needs to generate significant locking force to lock a single keeper 18 at once. In one exemplary embodiment, the first engagement member 81 passes the crown 19C of the corresponding keeper 18 before or concurrently with the next engagement member 81 engaging the corresponding bracket 18. Thus, the overall necessary locking force is both lower and more consistent, and manipulation of the actuator is easier and smoother than in previous locking mechanisms.

The arrangement of the actuator 60 and the linkage member 70 described above affords many advantages, including greater locking force, as well as increased range of movement, which enables and/or enhances sequential locking. In one exemplary embodiment, the locking mechanism 38 provides for more than 2 inches of movement of the lock bar 80 during locking and unlocking. The two-pin arrangement allows for a longer driving arm 62 on the actuator, creating greater force through leverage. Additionally, the longer driving arm 62 permits a greater range of motion for the linkage member 70, which creates sufficient range of movement of the lock bar 80 to enable sequential locking. Consequently, the locking mechanism 38 provides easier and smoother operation than prior locking mechanisms. Still other advantages are provided by the locking mechanism 38.

FIGS. 28-32 show another embodiment of a locking mechanism 338 for a casement window assembly 10. Many components of the locking mechanism 338 of FIGS. 28-32 are similar to those described above with respect to the locking mechanism 38 described above, and are referred to similarly using the "300" series of reference numbers. The locking mechanism 338 generally includes a housing 340, an actuator 360, a linkage member 370, a lock bar 380, and a keeper 318. The actuator 360 is moveable to operate the locking mechanism 338 for locking and unlocking the window assembly 10. The locking mechanism 338 is mounted to the window assembly 10 such that the housing 340 is mounted on the exterior of one of the vertical jambs 29, the actuator 360 and linkage member 370 are mounted within the housing 340, the lock bar 380 is mounted within the same jamb 29, and the keeper 318 is mounted to the vertical rail 26 adjacent the jamb 29.

The actuator 360 is made of metal and has a handle portion 361 and an driving portion 362 connected by a connecting portion 363. The connecting portion 363 is a narrow shaft extending transversely to the handle portion 361 and the driving portion 362, giving the actuator 360 a stepped configuration. Also, as described below, the connecting portion 363 forms a fulcrum or pivot point 367 for pivoting of the actuator 360. The handle portion 361 has a gripping structure 364 at the tip to facilitate manipulation of the actuator 360 by a user. The driving portion 362 has two gliding pins 365, 366 (FIG. 30), including a proximal gliding pin 365 that is close to the fulcrum 367 and a distal gliding pin 366 that is farther from the fulcrum 367. Because the gliding pins 365, 366 are different distances from the fulcrum 367, they have different arcs of angular movement when the actuator 360 is pivoted about the fulcrum 367. Additionally, the distal gliding pin 366 is preferably slightly longer than the proximal gliding pin 365, the significance of which is described below.

Figure 32:
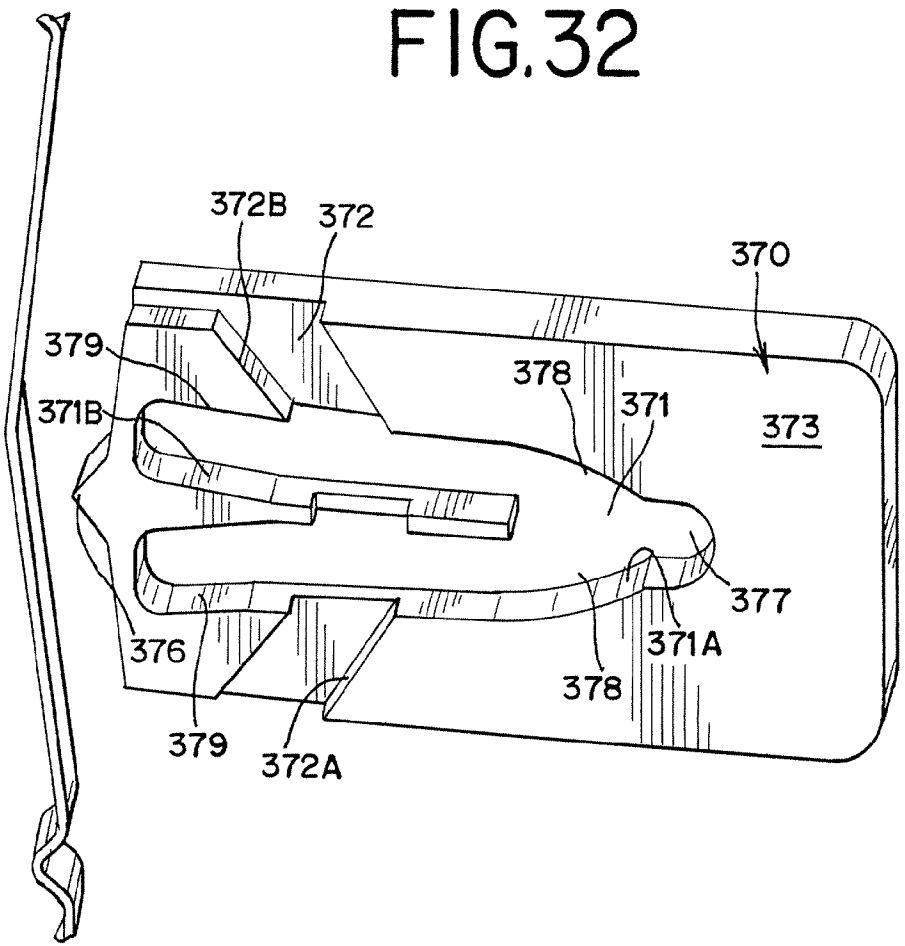
FIG. 32 is a perspective view of a linkage member of the casement window locking mechanism of FIG. 28.
Figure 31:
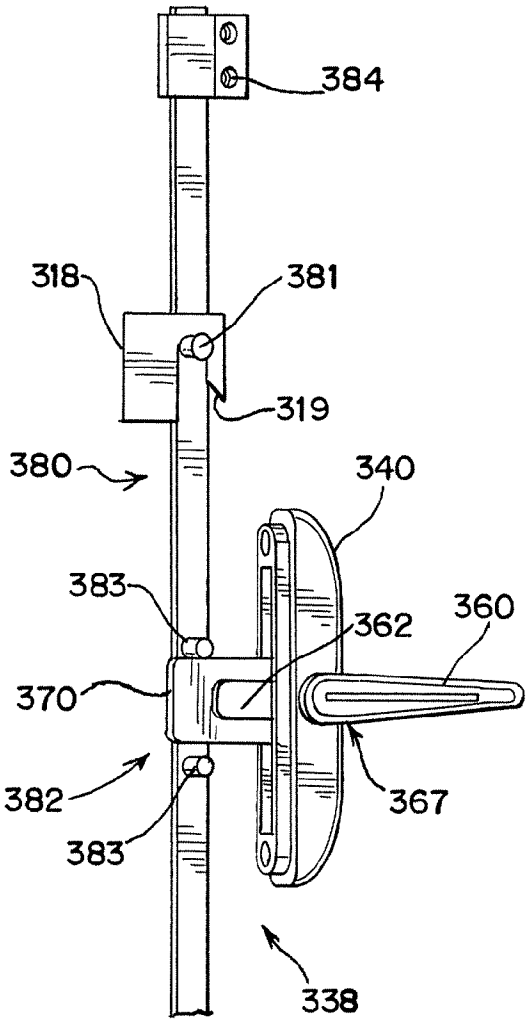
FIG. 31 is an assembled view of the casement window locking mechanism of FIG. 28.

The linkage member 370 of the locking mechanism 338 shown in FIGS. 28-32 is illustrated in greater detail in FIG. 32. The linkage member 370 is preferably a rectangular metal plate or block having a first channel 371 and a second channel 372 on a first face 373 of the linkage member 370 and a projection 374 on a second, opposed face 375 of the linkage member 370. The first channel 371 is long and sharply curved, forming a general U-shape, V-shape, or "wishbone-shape" channel 371. The first channel 371 is defined by a plurality of inner surfaces, including inward-facing inner surfaces 371A and outward facing inner surfaces 371B, and has a rounded tip 377 and two outwardly-curved wells 378 on either side of the tip 377 (FIG. 32). The second channel 372 is shorter and more gradually curved, and may even be angular. The second channel 372 is also defined by a plurality of inner surfaces 372A and an outer surface 72B. Additionally, the first channel 371 is slightly deeper than the second channel 372. Because the first channel 371 is deeper than the second channel 372, the inner surfaces 371A, 371B of the first channel 71 are still defined where the first channel 371 and the second channel 372 intersect. The actuator 360 is connected to the linkage member 370 such that the distal gliding pin 366 is received in the first channel 371 and the proximal gliding pin 365 is received in the second channel 372. The projection 374 may be a bar, ridge, or other protuberance that extends from the second face 375 of the linkage member 370 and is received in a track 348 in the housing 340 as discussed below. In other embodiments, the linkage member 370 may have a different configuration, including differently shaped channels 371, 372 and a differently shaped profile. Further, the linkage member 370 has a point 376 at one end, which interacts with a spring 349 within the housing 340 as described below.

The lock bar 380 is an elongated metal strip having an engagement member 381 for engaging the keeper 318 and connection assembly 382 for connecting to the linkage member 370. The engagement member 381 is generally a round post, having a narrow stem and an enlarged cap, and projects from one side of the lock bar 380. The engagement member 381 and the keeper 318 cooperatively engage each other such that the narrow stem of the post 381 is received within the keeper 318, and the enlarged cap limits lateral movement between the post 381 and the keeper 318. The keeper 318 has a ramp portion 319 which allows the upward movement of the knob 381 to pull the window 16 farther closed as the knob 381 is moved into the keeper 318. In other embodiments, the engagement member 381 and the keeper 318 can have many different configurations beyond those shown and described. The connection assembly 382 includes two posts 383 projecting from the side of the lock bar 380. The rectangular linkage member 370 is received between the two posts 383 so that movement of the linkage member 370 will cause the linkage member 370 to abut one of the two posts 383 and force the lock bar 380 to move in the same direction. In other embodiments, the connection assembly 382 can be configured differently and may connect to the linkage member 370 in a different manner. For example, the linkage member 370 and the connection assembly 382 may have cooperatively engaging structures or a hinge connection. The locking assembly 338 also includes at least one retainer 384 mounted within the jamb 29, which holds the lock bar 380 and allows the lock bar 380 to slide back and forth therein.

As shown in FIGS. 28-31, the housing 340 is a two-piece metal housing 340, having a base 342 and a cover 344, and generally includes an interior cavity 346, an interior track 348, an elongated slot 350, one or more fastener holes 352, and a actuator mount 354 for connection to the actuator 360. The cover 344 and the base 342 combine to define the interior cavity 346, and the linkage member 370 and a portion of the actuator 360 are positioned in the interior cavity 346. The base 342 and cover 344 can have many different configurations. In the embodiment shown in FIGS. 28-31, the cover 344 forms part of the side wall and the actuator mount 354 of the housing 340. However, in another embodiment (not shown), the cover 344 only forms the area around the slot 350, and the actuator mount 354 is completely defined by the base 342. Alternately, the housing 340 may consist of only a single piece, or may be multiple pieces. The fastener holes 352 receive fasteners (not shown) therethrough for attaching the housing 340 to the window frame 14. In the embodiment shown, the housing 340 also has pillars 356 that extend through the base 342 and the cover 344, surrounding the fastener holes 352. Additionally, the pillars 356 are received in apertures 358 in the cover 344 to hold the cover 344 in place relative to the base 342. The track 348 is an elongated groove defined by a portion of the base 342 and a portion of the cover 344, and receives the projection 374 of the linkage member 370. In other embodiments, the track 348 may be a ledge, rather than a groove. The track 348 may also be formed by the insertion of a plate or block within the housing that has a ledge or a groove on which the projection 374 of the linkage member 370 can slide.

The actuator 360 and the linkage member 370 are connected to the housing 340, and are partially positioned within the housing 340. The actuator 360 is mounted on the actuator mount 354, which, in the embodiment shown, is an aperture in the side wall of the housing 340, through which the connecting portion 363 of the actuator 360 extends. In this arrangement, the handle portion 361 of the actuator 360 is positioned outside the housing 340 and the driving portion 362 of the actuator moves within the housing 340. Additionally, the actuator mount 354 combines with the connecting portion 363 to provide the fulcrum or pivot point 367, forming a pivot axis about which the entire actuator 360 pivots. A bushing or bearing 368 may be positioned between the connecting portion 363 and the actuator mount 354, allowing for smoother pivoting of the actuator 360. The linkage member 370 is also positioned within the housing 340 and slides back and forth within the housing 340 with the movement of the actuator 360. The slot 350 is elongated to allow the linkage member 370 a wide range of motion as it moves from one end of the slot 350 to the other. The jamb 29 also has a slot 351 corresponding to the slot 350 of the housing 340, through which the linkage member 370 extends to connect to the lock bar 380. The track 348 preferably receives the projection 374 of the linkage member 370. As the linkage member 370 moves within the housing 340, the projection 374 slides within the elongated track 348, from one end of the track 348 to the other, and the track 348 stabilizes the linkage member 370, ensuring that the linkage member 370 moves linearly rather than rotating.

The actuator 360 and linkage member 370 are movable in a range of movement between two extreme positions, proximate the ends of the slot 350, with a central position therebetween. The driving portion 362 of the actuator 360 and the linkage member 370 are connected such that pivoting of the actuator 360 is translated into linear motion by the linkage member 370 to achieve a mechanical advantage. The actuator 360 is connected to the linkage member 370 such that the distal gliding pin 366 is received in the first channel 371 and the proximal gliding pin 365 is received in the second channel 372. As the actuator 360 is pivoted, the proximal gliding pin 365 glides through the second channel 372 and the distal gliding pin 366 glides through the first channel 371. Because the distal gliding pin 366 is longer than the proximal gliding pin 365 and the first channel 371 is deeper than the second channel 372, the pins 365, 366 remain in their respective channels 371, 372 and do not slip into the wrong channel 371, 372 during operation, allowing the channels 371, 372 to intersect. When the actuator 360 is in the central position, the distal pin 366 is received in the rounded tip 377 at the end of the first channel 371. Within a first range of incremental movements of the actuator 360 in either direction, the distal pin 366 pushes against an inward-facing inner surface 371A of the first channel 371 in the tip 377 to force the linkage member 370 to move laterally.

After a certain range of movement of the actuator 360, the proximal pin 365 contacts an inner surface 372A of the second channel 372 and exerts force on the inner surface 372A. At approximately the same time, the distal pin 366 slips out of the tip 377 of the first channel 371 and into one of the wells 378 of the first channel 371. The wells 378 are curved outwardly so that the distal pin 366 no longer contacts the outer wall 371A of the first channel and moves freely for a range of movement. Thus, within a second range of incremental movement, only the proximal pin 365 is driving movement of the linkage member 370. Because the length of the handle portion 361 of the actuator 360 is large compared to the lever arm between the proximal pin 365 and the fulcrum 367, greater force is exerted on the linkage member 370 and the mechanism 338 achieves a mechanical advantage and greater locking force.

After a further range of movement, the proximal pin 365 has traveled completely through the second channel 372 and slips out of the channel 372, so the proximal pin 365 can no longer drive movement of the linkage member 370. At approximately the same time, the distal pin 366 reaches the end of the well 378 and begins to once again contact the first channel outer wall 371A and force the linkage member 370 to move. Thus, within a third range of incremental movement, only the distal pin 366 is driving movement of the linkage member 370. Through the third range of movement, inclined portions 379 of the first channel 371 ease the movement of the actuator 360, and give the mechanism 338 a mechanical advantage and greater locking force. After the third range of movement, the actuator 360 is generally at an extreme position of its range of movement.

The movement of the actuator 360 can also be reversed from the extreme position back toward the central position, and achieves similar mechanical advantages as described above with respect to movement from the central position. As the movement of the actuator 360 is reversed through the third range of movement, the distal pin 366 contacts an inclined portion 379 on the first channel inner surface 371A, causing the linkage member 370 to move in the reverse direction. As before, after a certain range of movement, the distal pin 366 will enter the well 378 and the proximal pin 365 will enter the second channel 372. As the actuator 360 is moved back toward the central position, the proximal pin 365 will engage the second channel inner surface 372B and exert force on the linkage member 370. Thus, as before, the actuator 360 will move through the second range of movement where only the proximal pin 365 is driving movement of the linkage member 370. As the actuator 360 approaches the central position, the distal pin 366 will slip into the tip 377 of the first channel 371.

As the linkage member 370 moves within the housing 340, the projection 374 rides within the track 348 of the housing 340, stabilizing and guiding the motion of the linkage member 370. This engagement helps ensure linear motion of the linkage member 370. Further, a spring 349 positioned within the housing 340 interacts with the linkage member 370. Specifically, the spring 349 has three indents 347, one positioned at the center of the spring 349 and two positioned at either end of the spring 349. At the central position and the two extreme positions of movement of the actuator 360 and linkage member 370, the point 376 of the linkage member 370 is received in one of the indents 347.

Generally, the engagement member 381 of the lock bar 380 and the keeper 318 cooperatively engage each other to secure the jamb 29 to the rail 26, locking the window assembly 10 shut. As described above, the knob 381 is received in the keeper 318, securing the window 16 and preventing the window 16 from opening. Additionally, the linkage member 370 is operably connected to the connection assembly 382 of the lock bar 380, such that movement of the actuator 360 moves the linkage member 370, which in turn moves the lock bar 380 to engage or disengage with the keeper 318. As described above, the linkage member 370 is received between the two posts 383 of the lock bar 380, connecting the linkage member 370 to the lock bar 380. Thus, the locking mechanism 338 is moveable between a locked position, where the lock bar 380 engages the keeper 318 and the window assembly 10 is locked closed, and an unlocked position, where the lock bar 380 does not engage the keeper 318 and the window assembly 10 may be freely opened and closed.

Figure 33:
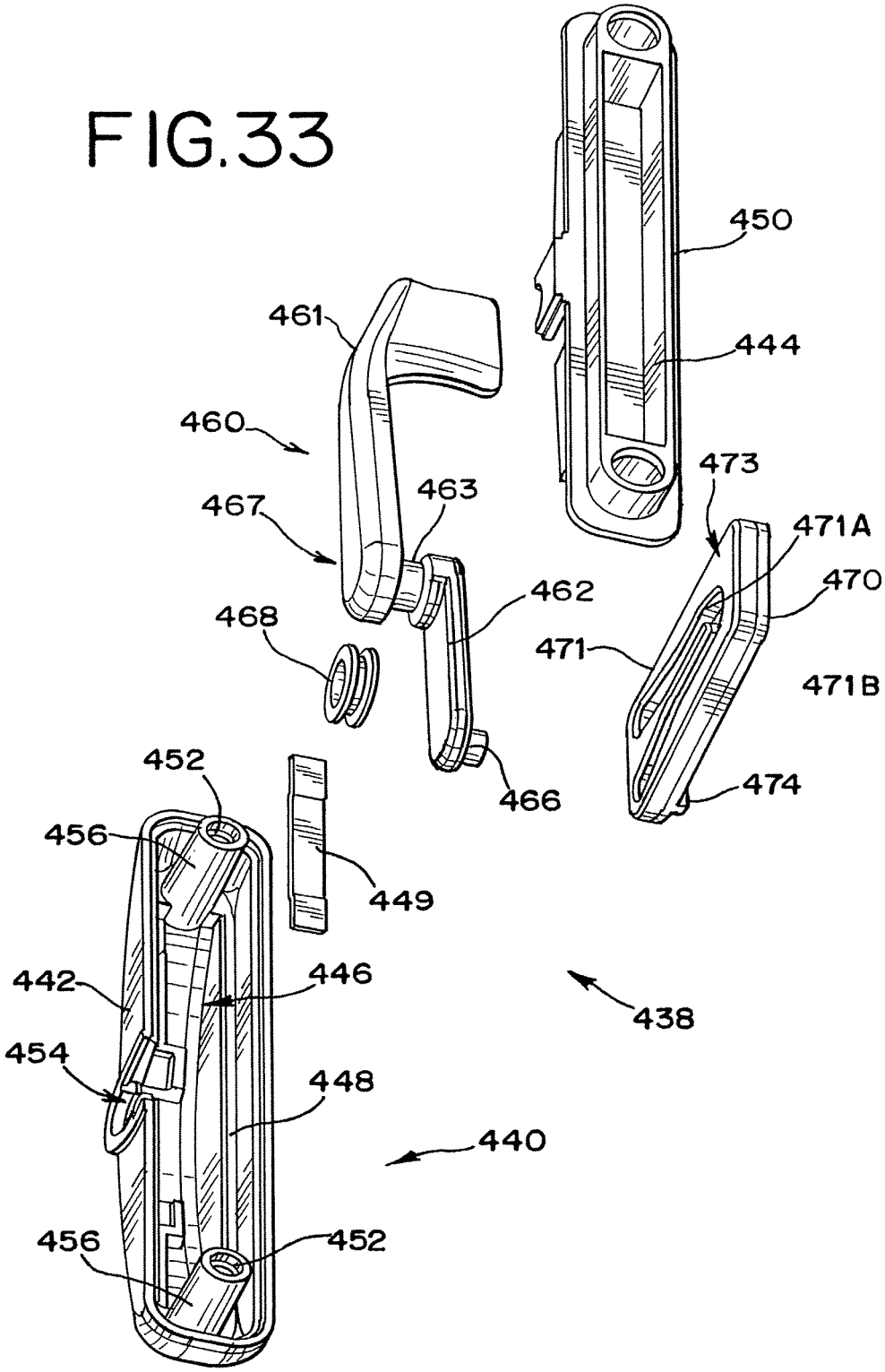
FIG. 33 is an exploded perspective view of a further embodiment of a casement window lock (FIG. 6)
Figure 34:
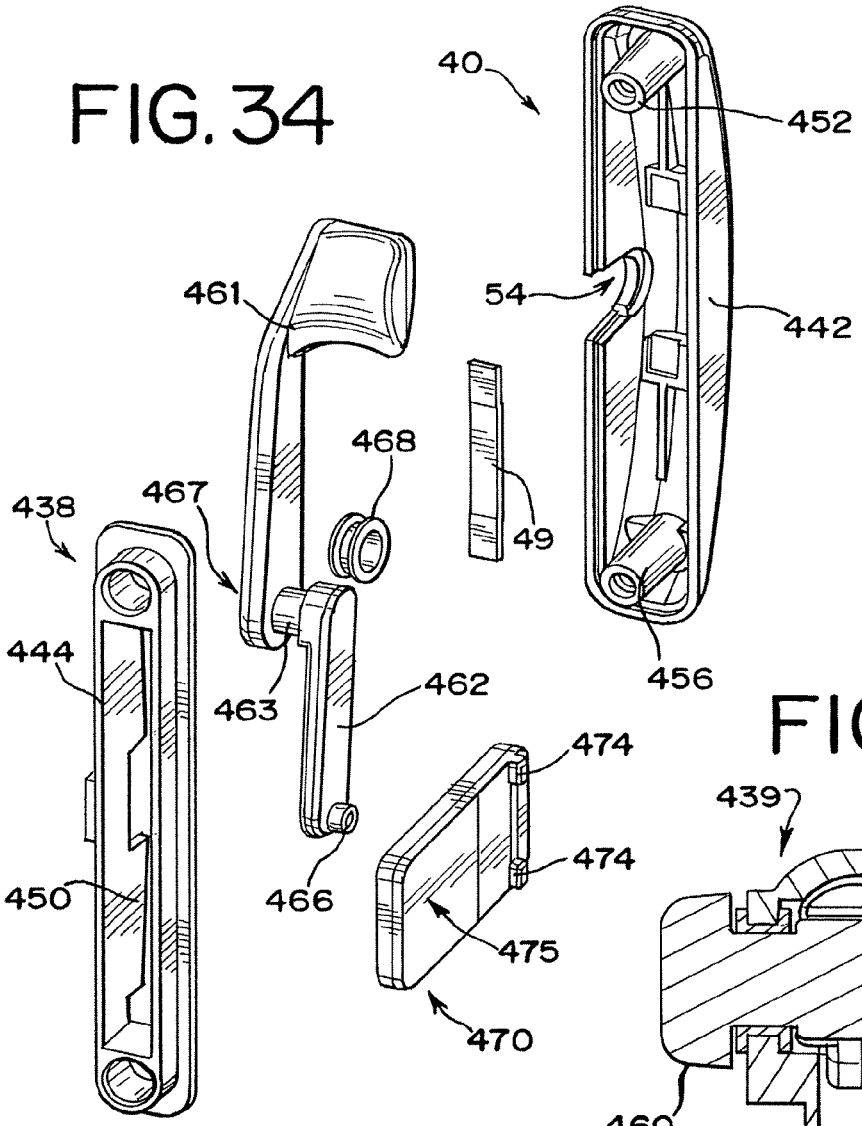
FIG. 34 is an exploded rear perspective view of the casement window lock of FIG. 33.
Figure 35:
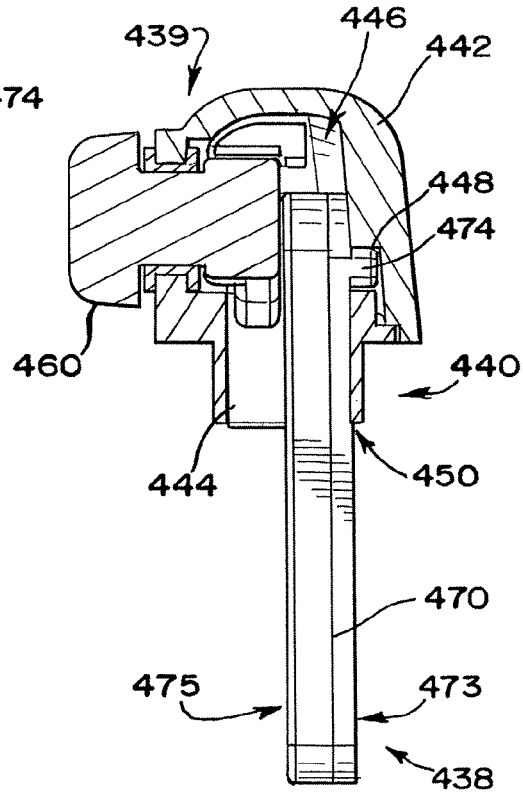
FIG. 35 is a cross-sectional view of the casement window lock of FIG. 33 in an assembled condition.

FIGS. 33-35 show a further embodiment 438 of the locking mechanism. The components and action of the locking mechanism 438 are similar to those described above with respect to the locking mechanism 338 of FIGS. 28-32, with several notable exceptions. The housing 440 and handle portion 461 of the locking mechanism 438 are more contoured in shape than those of the previous embodiment 338. Additionally, the spring 449 is relatively small and has no indents 447. Further, the linkage member 470 of the locking mechanism 438 has two projections 474 rather than a single projection 374, as in the previous embodiment 338. An important difference is that the actuator 460 has only a distal pin 466, and no proximal pin, and the linkage member 470 correspondingly has only a single channel 471. Thus, in the locking mechanism 438, the distal pin 466 drives the entire movement of the linkage member 470.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "upper," "lower," "horizontal," "vertical," etc., as used herein, are intended for illustrative purposes only and do not limit the embodiments in any way. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A locking mechanism for a casement window assembly for selectively locking a casement window sash within a casement window frame, the locking mechanism comprising:

a housing adapted to be mounted on a window frame or window sash of the window assembly, the housing having an elongated opening having first and second opposed ends;

an actuator operably connected to the housing and pivotable about a fulcrum, the actuator comprising an actuator body having a first pin and a second pin located thereon and having a handle portion thereon for manipulation by a user; and a linkage member having a first channel and a second channel, the linkage member connected to the actuator such that the first pin is received in the first channel and the second pin is received in the second channel, wherein the first channel is substantially U-shaped, and the second channel is positioned substantially inside the first channel, wherein pivoting the actuator by a user about the fulcrum causes the first pin to move within the first channel and causes the second pin to move within the second channel, thereby causing the linkage member to move along the opening from a first position proximate the first end of the opening to a second position proximate the second end of the opening thereby moving a lock bar between a locked position adapted to secure the window assembly in a closed position and an unlocked position wherein the window assembly can be freely opened and closed.

2. The locking mechanism of claim 1, wherein the first channel extends completely through the linkage member.

3. The locking mechanism of claim 2, wherein the first channel further comprises a ledge extending around a perimeter of the first channel, and the first pin further comprises an extended portion defining a step on the first pin, wherein the extended portion extends in to the first channel and the step rides along the ledge as the first pin moves within the first channel.

4. The locking mechanism of claim 1, wherein the linkage member has a first face and a second, opposed face, the first channel and the second channel being recessed from the first face, and the linkage member further comprises a projection extending from the second face, the projection riding within a track on the housing.

5. The locking mechanism of claim 1, wherein the first pin has a length that is greater than a length of the second pin and the first channel has a depth that is greater than a depth of the second channel.

6. The locking mechanism of claim 1, wherein the linkage member travels along a path from the first position to the second position, the path comprising a first portion, wherein the first pin exerts force on an inner surface of the first channel to move the linkage member, and a second portion, wherein the second pin exerts force on an inner surface of the second channel to move the linkage member.

7. The locking mechanism of claim 1, further comprising a spring within the housing, the spring having an indent, the spring engaging one of the actuator and the linkage member to provide a tactile indication to a user of a position of the linkage member such that the one of the actuator and the linkage member has a protrusion that is received within the indent when the linkage member is in the position, creating the tactile indication.

8. A locking mechanism for a casement window assembly for selectively locking a casement window sash within a casement window frame, the locking mechanism comprising:

a housing adapted to be mounted on a window frame or window sash of the window assembly;

an actuator mounted to the housing and pivotable about a fulcrum, the actuator comprising a handle for manipulation by a user located on one side of the fulcrum and two pins located on an opposed side of the fulcrum, one pin being proximal to the fulcrum and the other pin being distal from the fulcrum;

a linkage member having a first channel and a second channel, the linkage member connected to the actuator such that the distal pin is received in the first channel and the proximal pin is received in the second channel wherein the first channel is substantially U-shaped, and the second channel is positioned substantially inside the first channel, wherein pivoting the actuator by a user about the fulcrum causes the distal pin to glide within the first channel and causes the proximal pin to glide within the second channel, thereby causing the linkage member to move in linear movement; and a lock bar operably connected to the linkage member, such that the pivoting of the actuator by a user moves the lock bar between a locked position, wherein the lock bar is adapted to secure the window assembly in a closed position, and an unlocked position, wherein the window assembly can be freely opened and closed.

9. A locking mechanism for a casement window assembly for selectively locking a casement window sash within a casement window frame, the locking mechanism comprising:

a housing adapted to be mounted on a window frame or window sash of the window assembly, the housing having an elongated opening having first and second opposed ends;

an actuator operably connected to the housing and pivotable about a fulcrum, the actuator comprising an actuator body having a first pin and a second pin located thereon and having a handle portion thereon for manipulation by a user;

a linkage member having a first channel and a second channel, the linkage member connected to the actuator such that the first pin is received in the first channel and the second pin is received in the second channel, wherein pivoting the actuator by a user about the fulcrum causes the first pin to move within the first channel and causes the second pin to move within the second channel, thereby causing the linkage member to move along the opening from a first position proximate the first end of the opening to a second position proximate the second end of the opening thereby moving a lock bar between a locked position adapted to secure the window assembly in a closed position and an unlocked position wherein the window assembly can be freely opened and closed; and a spring within the housing, the spring having an indent, the spring engaging one of the actuator and the linkage member to provide a tactile indication of a position of the linkage member to a user such that the one of the actuator and the linkage member has a protrusion that is received within the indent when the linkage member is in the position, creating the tactile indication.

* * * * *